US009207611B2

(12) United States Patent
Woo et al.

(10) Patent No.: US 9,207,611 B2
(45) Date of Patent: Dec. 8, 2015

(54) IMAGE FORMING APPARATUS AND CONTROL METHOD THEREOF

(71) Applicant: Samsung Electronics Co., Ltd., Suwon-si (KR)

(72) Inventors: Sang Bum Woo, Seoul (KR); Sung Dae Kim, Suwon-si (KR); Soo Yong Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/166,130

(22) Filed: Jan. 28, 2014

(65) Prior Publication Data

US 2014/0212186 A1 Jul. 31, 2014

(30) Foreign Application Priority Data

Jan. 31, 2013 (KR) ..... 10-2013-0011202

(51) Int. Cl.
*G03G 15/22* (2006.01)
*G03G 15/01* (2006.01)
*G03G 15/00* (2006.01)

(52) U.S. Cl.
CPC ..... *G03G 15/55* (2013.01); *G03G 15/5058* (2013.01); *G03G 2215/0158* (2013.01)

(58) Field of Classification Search
CPC ..... G03G 2215/0158; G03G 2215/0161
USPC ..... 399/301
See application file for complete search history.

(56) References Cited

U.S. PATENT DOCUMENTS 5,160,946 A * 11/1992 Hwang ..... 347/116
2011/0026980 A1* 2/2011 Mizushima et al. ..... 399/301
2011/0150516 A1* 6/2011 Kim et al. ..... 399/66

FOREIGN PATENT DOCUMENTS

JP 05241457 A * 9/1993

* cited by examiner

*Primary Examiner* — Clayton E Laballe
*Assistant Examiner* — Leon W Rhodes, Jr.
(74) *Attorney, Agent, or Firm* — Staas & Halsey LLP

(57) ABSTRACT

An image forming apparatus and method which reduces time taken for color registration and reflects misregistration of colors in real time to correct color misregistration of prints are provided. Image forming apparatus may include photoconductor elements corresponding to colors; first sensing unit arranged between first and second photoconductor elements among photoconductor elements, and sensing toner images transferred to intermediate transfer body; final sensing unit arranged after final photoconductor element among photoconductor elements, and sensing transferred toner images; and controller calculating fixed errors of remaining colors except for first color among colors, with respect to first color corresponding to first photoconductor element, based on output values of final sensing unit before printing, calculating variable error based on output value of first sensing unit during printing, and adjusting scanning time of at least one color of remaining colors in real time in consideration of fixed errors and variable error.

41 Claims, 22 Drawing Sheets

IMAGE FORMING APPARATUS AND CONTROL METHOD THEREOF

CROSS-REFERENCE TO RELATED APPLICATIONS

This application claims the priority benefit of Korean Patent Application No. 2013-0011202, filed on Jan. 31, 2013 in the Korean Intellectual Property Office, the disclosure of which is incorporated herein by reference.

BACKGROUND

1. Field

Embodiments relate to an image forming apparatus for forming color images based on a single-pass method, and a control method of the image forming apparatus.

2. Description of the Related Art

In general, an electro-photographic image forming apparatus, such as a laser printer, a digital copier, and the like, prints images by irradiating light on a photoconductor charged with a desired potential to form an electrostatic latent image on a surface of the photoconductor, feeding toner which is developer to the electrostatic latent image to form a visible image, and then transferring the visible image to paper.

When a color image forming apparatus forms color images, if images of different colors overlap at misaligned positions, the resultant prints come to have blurred edges. The blurring occurs due to a complicated interaction of various factors, such as replacement of a developer, excessively increasing the number of copies, etc., resulting in deterioration of print quality. In order to prevent deterioration of print quality, color registration for accurately aligning images of different colors to overlap them at exact positions is needed.

Conventional image forming techniques have required a separate job in addition to a print job in order to determine misregistration of colors or to register colors in consideration of misregistration, which leads to deterioration in efficiency of printing. Also, since the conventional image forming techniques cannot reflect misregistration in real time, the reliability of color registration cannot be ensured.

SUMMARY

In an aspect of one or more embodiments, there is provided an image forming apparatus capable of reducing a time taken for color registration and reflecting misregistration of colors in real time so as to correct color misregistration of all prints, and a control method of the image forming apparatus.

In an aspect of one or more embodiments, there is provided an image forming apparatus includes: a plurality of photoconductor elements arranged in a movement direction of an intermediate transfer body, and corresponding to a plurality of colors, the plurality of colors including a first color and remaining colors; a light scanner which irradiates light on the plurality of photoconductor elements to form electrostatic latent images; a developer which supplies toner to the plurality of photoconductor elements to form toner images on the plurality of photoconductor elements; the intermediate transfer body to which the toner images formed on the plurality of photoconductor elements are transferred; a first sensor, which is arranged between a first photoconductor element and a second photoconductor element among the plurality of photoconductor elements, and which senses the toner images transferred to the intermediate transfer body; a final sensor arranged after a final photoconductor element among the plurality of photoconductor elements, and which senses the toner images transferred to the intermediate transfer body; and a controller which calculates fixed errors of the remaining colors, with respect to the first color corresponding to the first photoconductor element, based on output values of the final sensor before printing, which calculates a variable error based on an output value of the first sensor during printing, and which adjusts a scanning time of at least one color of the remaining colors in real time in consideration of the fixed errors and the variable error.

The controller may comprise an image forming controller which may control the light scanner such that a plurality of pre-test patterns are transferred from the plurality of photoconductor elements to the intermediate transfer body before printing, and the image forming controller may control the light scanner such that a main-test pattern is transferred from the first photoconductor element to an non-image area of the intermediate transfer body during printing.

The controller may further include a pre-Auto Color Registration (pre-ACR) unit which calculates the fixed errors based on output values of the final sensor that has sensed the pre-test patterns.

The controller may further include a main-ACR unit calculating the variable error based on an output value of the first sensor that has sensed the main test pattern, and calculating correction amounts for scanning times of the remaining colors, based on the variable error and the fixed errors.

Each of the first sensor and the final sensor may include an optical sensor and a counter.

The plurality of photoconductor elements may include the first photoconductor element corresponding to the first color, the second photoconductor element corresponding to a second color, a third photoconductor element corresponding to a third color, and a fourth photoconductor element corresponding to a fourth color, the final photoconductor element is the fourth photoconductor element, and the final sensor is a fourth sensor.

The first sensor may measure a time taken for a pre-test pattern of the first color to be sensed from when scanning onto the first photoconductor element starts.

The fourth sensor may measure a time taken for the pre-test pattern of the first color to be sensed from when scanning onto the first photoconductor element starts, a time taken for a pre-test pattern of the second color to be sensed from when scanning onto the second photoconductor element starts, a time taken for a pre-test pattern of the third color to be sensed from when scanning onto the third photoconductor element starts, and a time taken for a pre-test pattern of the fourth color to be sensed from when scanning onto the fourth photoconductor element starts.

The pre-ACR unit may calculate a fixed error of the second color with respect to the first color, a fixed error of the third color with respect to the first color, and a fixed error of the fourth color with respect to the first color, based on the times measured by the fourth sensor.

The first sensor may measure a time taken for a main-test pattern of the first color to be sensed from when scanning onto the first photoconductor element starts.

The main ACR unit may compare a time taken for the pre-test pattern of the first color to be sensed from when scanning onto the first photoconductor element starts, to a time taken for the main-test pattern of the first color to be sensed from when scanning onto the first photoconductor element starts, thereby calculating a variable error.

The main ACR unit may add a fixed error of the second color with respect to the first color to the variable error to calculate a scanning time correction amount of the second color, add a fixed error of the third color with respect to the first color to the variable error to calculate a scanning time correction amount of the third color, and add a fixed error of the fourth color with respect to the first color to the variable error to calculate a scan time correction amount of the fourth color.

The controller may adjust scanning times of the first through fourth colors according to the scanning time correction amounts of the first through fourth colors.

The image forming apparatus may further include a second sensor arranged between the second photoconductor element and the third photoconductor element, and a third sensor arranged between the third photoconductor element and the fourth photoconductor element.

The second sensor may measure a time taken for the pre-test pattern of the second color to be sensed from when scanning onto the second photoconductor element starts, and the third sensor may measure a time taken for the pre-test pattern of the third color to be sensed from when scanning onto the third photoconductor element starts.

The pre-ACR unit may calculate a fixed error of the second color with respect to the first color, a fixed error of the third color with respect to the first color, and a fixed error of the fourth color with respect to the first color, based on the times measured by the fourth sensor.

The first sensor may measure a time taken for a main-test pattern of the first color to be sensed from when scanning onto the first photoconductor element starts.

The main ACR unit may compare the time taken for the pre-test pattern of the first color to be sensed from when scanning onto the first photoconductor element starts, to the time taken for the main-test pattern of the first color to be sensed from when scanning onto the first photoconductor element starts, thereby calculating a first variable error.

The main ACR unit may add a fixed error of the second color with respect to the first color to the first variable error, to calculate a scanning time correction amount of the second color.

The controller may control the light scanner according to the scanning time correction amount of the second color so that the main-test pattern of the second color is transferred from the second photoconductor element to a non-image area of the intermediate transfer body.

The second sensor may measure a time taken for the main-test pattern of the second color to be sensed from when scanning onto the second photoconductor element starts.

The main ACR unit may compare the time taken for the pre-test pattern of the second color to be sensed from when scanning onto the second photoconductor element starts, to the time taken for the main-test pattern of the second color to be sensed from when scanning onto the second photoconductor element starts, thereby calculating a second variable error.

The main ACR unit may add a fixed error of the third color with respect to the first color to the second variable error, to calculate a scanning time correction amount of the third color.

The controller may control the light scanning unit according to the scanning time correction amount of the third color so that the main-test pattern of the third color is transferred from the third photoconductor element to the non-image area of the intermediate transfer body.

The third sensor may measure a time taken for a main-test pattern of the third color to be sensed from when scanning onto the third photoconductor element starts.

The main ACR unit may compare the time taken for the pre-test pattern of the third color to be sensed from when scanning onto the third photoconductor element starts, to the time taken for the main-test pattern of the third color to be sensed from when scanning onto the third photoconductor element starts, thereby calculating a third variable error.

The main ACR unit may add a fixed error of the fourth color with respect to the first color to the third variable error, to calculate a scanning time correction amount of the fourth color.

In an aspect of one or more embodiments, there is provided a control method of an image forming apparatus, the image forming apparatus including a plurality of photoconductor elements corresponding to a plurality of colors, a first sensor arranged between a first photoconductor element and a second photoconductor element arranged in a movement direction of an intermediate transfer body, and a final sensor arranged after a final photoconductor element, the control method includes: if it is determined that pre-Auto Color Registration (pre-ACR) is needed, transferring a plurality of pre-test patterns of the plurality of colors to the intermediate transfer body before printing, the plurality of colors including a first color and remaining colors; sensing the pre-test patterns of the plurality of colors through the final sensor; calculating fixed errors of the remaining colors, with respect to the first color, based on output values of the final sensor; if a print command is received, transferring a main-test pattern of the first color to a non-image area of the intermediate transfer body during printing; sensing a main-test pattern of the first color through the first sensor; calculating a variable error based on an output value of the first sensor; and calculating a scanning time correction amount of at least one color of the remaining colors in consideration of the variable error and the fixed errors.

The calculating of the fixed errors of the remaining colors may include calculating differences between output values of the final sensor and reference values according to design values of the image forming apparatus.

The control method may further include sensing the pre-test pattern of the first color through the first sensor, wherein the calculating of the variable error includes calculating a difference between an output value of the first sensor that has sensed the pre-test pattern of the first color and an output value of the first sensor that has sensed the main-test pattern of the first color.

The calculating of the scanning time correction amount of the at least one color of the remaining colors may include adding the variable error to the respective fixed errors of the remaining colors to calculate scanning time correction amounts of the remaining colors.

The plurality of photoconductor elements may include the first photoconductor element corresponding to the first color, the second photoconductor element corresponding to a second color, a third photoconductor element corresponding to a third color, and a fourth photoconductor element corresponding to a fourth color, the final photoconductor element is the fourth photoconductor element, the final sensor is a fourth sensor, and the image forming apparatus may further include a second sensor arranged between the second photoconductor element and the third photoconductor element, and a third sensing unit arranged between the third photoconductor element and the fourth photoconductor element.

The control method according to claim 32 may further include: sensing a pre-test pattern of the first color through the first sensor; sensing a pre-test pattern of the second color through the second sensor; and sensing a pre-test pattern of the third color through the third sensor.

The calculating of the variable error may include comparing an output value of the first sensor that has sensed the pre-test pattern of the first color, to an output value of the first sensor that has sensed the main-test pattern of the first color, thereby calculating a first variable error.

The calculating of the scanning time correction amount of the at least one color of the remaining colors may include adding a fixed error of the second color with respect to the first color to the first variable error, to calculate a scanning time correction amount of the second color.

The control method may further include: transferring a main-test pattern of the second color to a non-image area of the intermediate transfer body in consideration of a scanning time correction amount of the second color, during printing; sensing a main-test pattern of the second color through the second sensor; and calculating a second variable error based on an output value of the second sensor.

The calculating of the second variable error may include calculating a difference between an output value of the second sensor that has sensed the pre-test pattern of the second color and an output value of the second sensor that has sensed the main-test pattern of the second color.

The control method may further include calculating a scanning time correction amount of the third color by adding a fixed error of the third color with respect to the first color to the second variable error.

The control method may further include: transferring a main-test pattern of the third color to the non-image area of the intermediate transfer body in consideration of a scanning time correction amount of the third color, during printing; sensing a main-test pattern of the third color through the third sensor; and calculating a third variable error based on an output value of the third sensor.

The calculating of the third variable error may include calculating a difference between an output value of the third sensor that has sensed the pre-test pattern of the third color and an output value of the third sensor that has sensed the main-test pattern of the third color.

The control method may further include adjusting a scanning time of the fourth color in consideration of the fixed error of the fourth color with respect to the first color and the third variable error.

Therefore, according to the image forming apparatus and the control method thereof as described above, it is possible to reduce a time taken for color registration and to correct color misregistration of all prints by reflecting misregistration between colors in real time.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
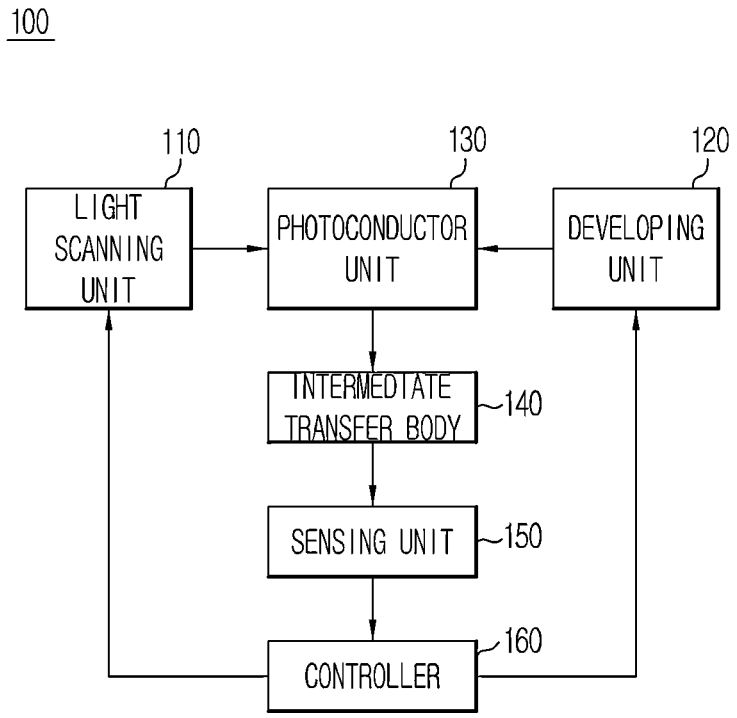
FIG. 1 is a control block diagram of an image forming apparatus according to an exemplary embodiment.

Reference will now be made in detail to embodiments, examples of which are illustrated in the accompanying drawings, wherein like reference numerals refer to like elements throughout.

FIG. 1 is a control block diagram of an image forming apparatus according to an exemplary embodiment.

Referring to FIG. 1, an image forming apparatus 100 includes a light scanning unit (light scanner) 110 for irradiating light on a plurality of photoconductor elements prepared for different colors to form electrostatic latent images on surfaces of the photoconductor elements, a developing unit (developer) 120 for supplying color toners corresponding to the photoconductor elements, respectively, to the photoconductor elements on which the electrostatic latent images have been formed to form toner images on the surfaces of the photoconductor elements, a photoconductor unit (photoconductor) 130 including the plurality of photoconductor elements, an intermediate transfer body 140 to which the toner images formed on the plurality of photoconductor elements are transferred, a sensing unit (sensor) 150 for sensing a toner image transferred to the intermediate transfer body 140, and a controller 160 for controlling scanning times of the light scanning unit 110 based on the output value of the sensing unit 150. The plurality of photoconductor elements corresponds to the plurality of colors which include a first color and remaining colors.

The sensing unit 150 includes one or more first sensing units arranged between first and second photoconductor elements arranged in the movement direction of the intermediate transfer body 140, and sensing the toner image transferred to the intermediate transfer body 140, and one or more second sensing units arranged after a final photoconductor element arranged in the movement direction of the intermediate transfer body 140, and sensing the toner image transferred to the intermediate transfer body 140.

The controller 160 calculates fixed errors of the remaining colors, with respect to the first color corresponding to the first photoconductor element, based on the output values of the first and second sensing units before printing, calculates a variable error based on the output values of the first sensing units during printing, and adjusts scanning times of the remaining colors in consideration of the fixed errors and the variable error.

The operations and structures of the above-mentioned elements will be described later, and a configuration for printing of the image forming apparatus 100 will be first described with reference to FIG. 2, below.

Figure 2:
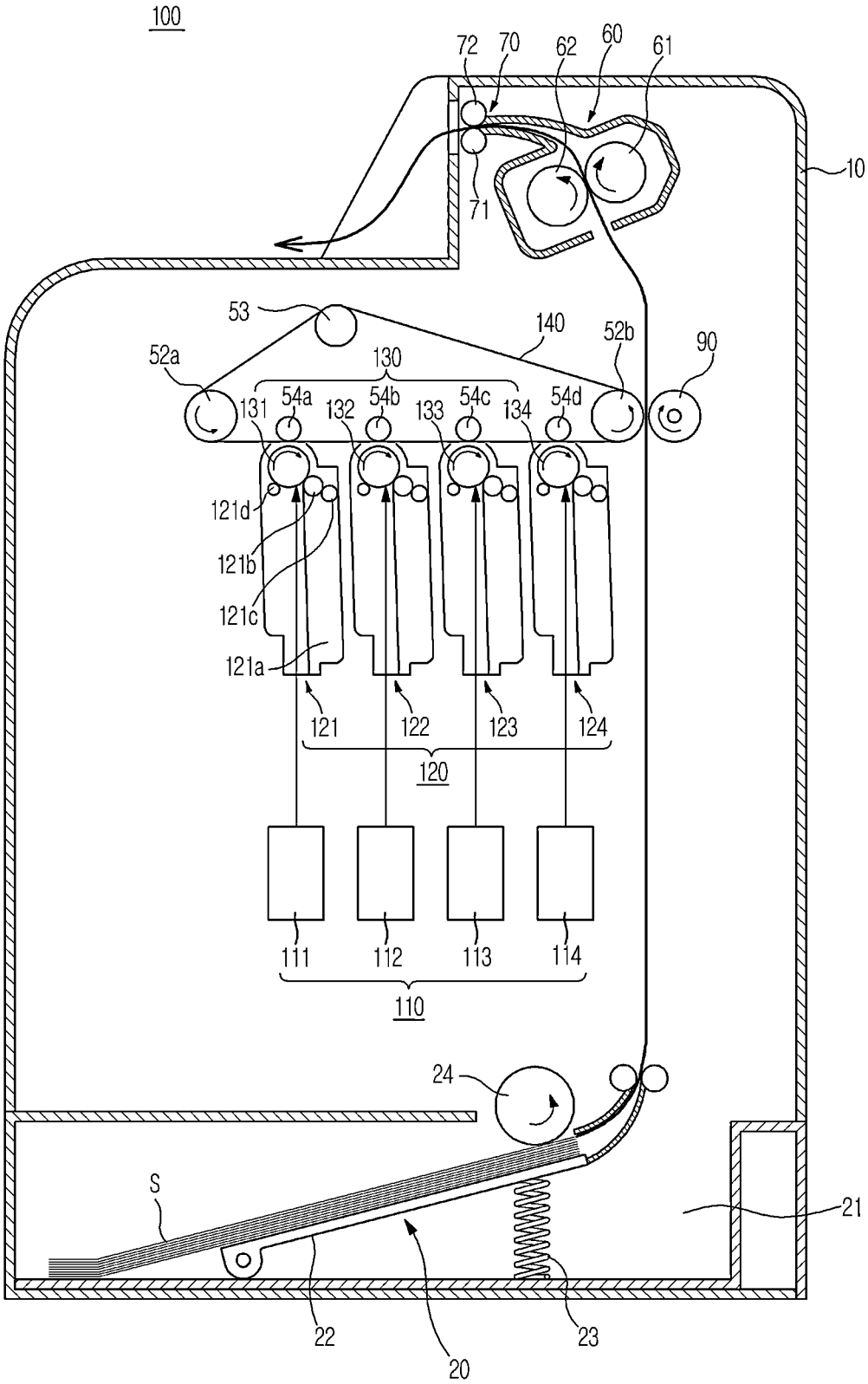
FIG. 2 is a side section view roughly illustrating an interior of an image forming apparatus according to an exemplary embodiment.

FIG. 2 is a side section view roughly illustrating an interior of an image forming apparatus according to an exemplary embodiment. Although not shown in FIG. 2, a plurality of sensing units are provided in the image forming apparatus, and an arrangement of the sensing units will be described with reference to FIG. 4, later.

In this exemplary embodiment, an image forming apparatus 100 is an image forming apparatus of forming color images based on a single-pass method.

Referring to FIG. 2, the image forming apparatus 100 includes a paper feeding unit 20, a light scanning unit 110, a developing unit 120, a photoconductor unit 130, an intermediate transfer body 140, a transfer roller 90, a fusing unit (fuser) 60, and a paper discharge unit (paper discharger) 70, in a main body 10 forming the external appearance of the image forming apparatus 100. In FIG. 2, an arrow extending from the paper feeding unit 20 to the paper discharge unit 70 represents a delivery path of paper S.

The paper feeding unit 20 includes a paper feeding cassette 21 detachably coupled to the lower part of the main body 10, a pressure plate 22 installed in the paper feeding cassette 21 so as to be movable up and down, on which paper S is loaded, an elastic element 23 provided below the pressure plate 22 and elastically supporting the pressure plate 22, and a pickup roller 24 arranged to come into contact with the top ends of the paper S and picking up the paper S one by one. The paper S is picked up by the pickup roller 24, and then delivered along the paper delivery path. Also, an additional roller(s) or a support(s) for supporting the delivery of the paper S may be provided on the paper delivery path.

The light scanning unit 110 functions to scan light beams corresponding to image information of a plurality of different colors, for example, black (K), yellow (Y), magenta (M), and cyan (C), onto the photoconductor unit 130. The light scanning unit 110 may be a Laser Scanning Unit (LSU) using a laser diode as a light source.

The light scanning unit 110 may include a plurality of scanners corresponding to the respective colors. According to one exemplary embodiment, the light scanning unit 110 may include a first scanner 111, a second scanner 112, a third scanner 113, and a fourth scanner 114 in correspondence to four colors. Each of the first to fourth scanners 111 to 114 irradiates light to the corresponding photoconductor element to form an electrostatic latent image on a surface of the photoconductor element. Accordingly, the photoconductor unit 130 may also include a first photoconductor element 131, a second photoconductor element 132, a third photoconductor element 133, and a fourth photoconductor element 134 in correspondence to the individual colors. Each photoconductor element may be a photoconductor drum on a surface of which a photoconductor layer is formed, and the first to fourth photoconductor elements 131 to 134 are arranged in the movement direction of the intermediate transfer body 140.

The developing unit 120 includes a first developer 121, a second developer 122, a third developer 123, and a fourth developer 124 in which toners of different colors, for example, toners of Black (K), Yellow (Y), Magenta (M), and Cyan (C) are respectively contained.

The first developer 121 includes a first toner storage unit 121*a* to store a first toner, a first developing roller 121*b* to develop an electrostatic latent image formed on the first photoconductor element 131 to a toner image, a first feeding roller 121*c* to feed the first toner to the first developing roller 121*b*, and a first charging roller 121*d* to charge the first photoconductor element 131. Likewise, the second, third, and fourth developers 122, 123, and 124 also include toner storage units, developing rollers, supply rollers, and charging rollers.

In this exemplary embodiment, toners of other colors in addition to Black (K), Yellow (Y), Magenta (M), and Cyan (C) may be used, however, in the following description, for convenience of description, it is assumed that toners of the above-mentioned four colors are used.

The intermediate transfer body 140 functions as an intermediate medium to transfer toner images developed on the outer surfaces of the photoconductor elements 131, 132, 133, and 134 to paper S. The intermediate transfer body 140 may be implemented as an intermediate transfer belt circulating while contacting the photoconductor elements 131 to 134. The intermediate transfer body 140 may be driven by driving rollers 52*a* and 52*b*, and a support roller 53 may be used to maintain the tension of the intermediate transfer body 140. Also, the image forming apparatus 100 may include four intermediate transfer rollers 54*a*, 54*b*, 54*c*, and 54*d* to transfer the toner images developed on the outer surfaces of the photoconductor elements 131, 132, 133, and 134 to the intermediate transfer body 140.

The transfer roller 90 is arranged to face the driving roller 52*b* of the intermediate transfer unit 140, and rotates together with the driving roller 52*b* to pass the paper S through between the transfer roller 90 and one surface of the intermediate transfer body 140, thereby transferring the toner image developed on the intermediate transfer body 140 to the paper S.

The fusing unit 60 serves to fuse the toner image onto the paper S by applying heat and pressure to the paper S. The fusing unit 60 includes a heating roller 61 having a heating source to apply heat to the paper S to which the toner image has been transferred, and a pressure roller 62 arranged to face the heating roller 61 so as to maintain a constant fusing pressure against the heating roller 61.

The paper discharge unit 70 is used to discharge the paper S to the outside of the main body 10, and includes a paper discharge roller 71 and a backup roller 72 rotating together with the paper discharge roller 71.

Operations of the image forming apparatus 100 will be described in detail based on the basic operations of the image forming apparatus 100 as described above.

Figure 3:
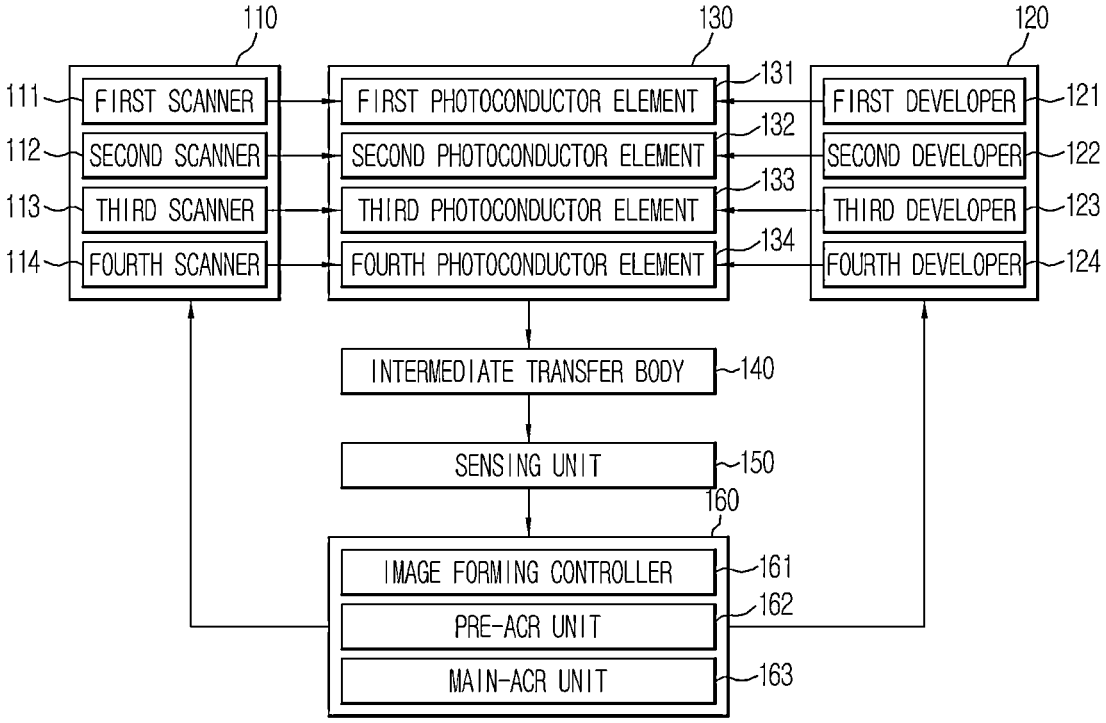
FIG. 3 is a control block diagram of an image forming apparatus according to an exemplary embodiment.
Figure 4:
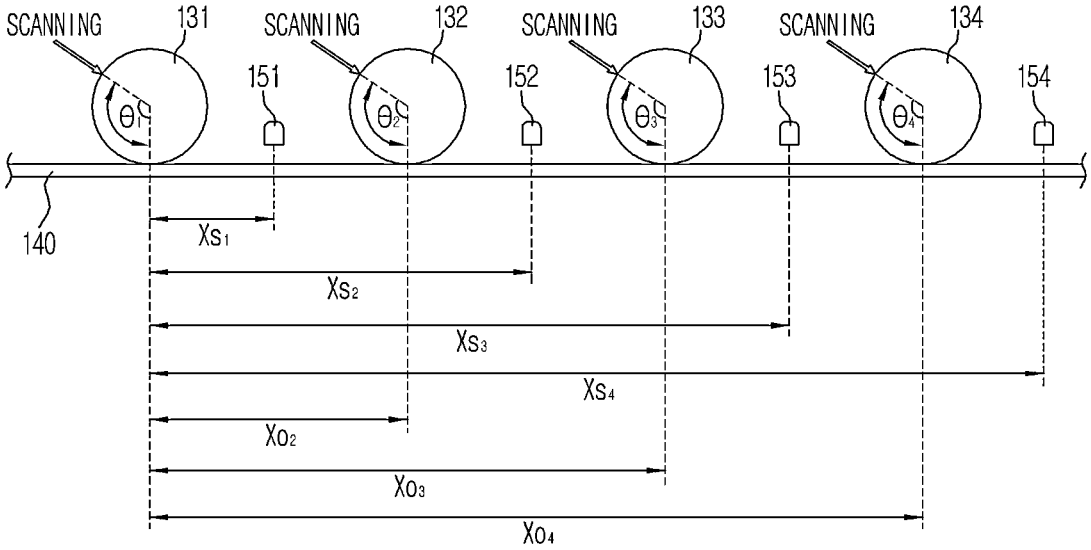
FIG. 4 illustrates an arrangement of sensing units included in an image forming apparatus, according to an exemplary embodiment.

FIG. 3 is a control block diagram of the image forming apparatus 100 according to an exemplary embodiment, and FIG. 4 illustrates an arrangement of sensing units included in the image forming apparatus 100, according to an exemplary embodiment.

As described above, referring to FIGS. 2 and 3, the image forming apparatus 100 forms images using four colors; the light scanning unit 110 includes the first scanner 111, the second scanner 112, the third scanner 113, and the fourth scanner 114 in correspondence to the four colors, the developing unit 120 includes the first developer 121, the second developer 122, the third developer 123, and the fourth developer 124, and the photoconductor unit 130 also includes the first photoconductor element 131, the second photoconductor element 132, the third photoconductor element 133, and the fourth photoconductor element 134.

In detail, the first scanner 111 forms an electrostatic latent image corresponding to image information of a first color on the first photoconductor element 131, and the first developer 121 feeds toner of the first color to the electrostatic latent image. The second scanner 112 forms an electrostatic latent image corresponding to image information of a second color on the second photoconductor element 132, and the second developer 122 feeds toner of the second color to the electrostatic latent image. The third scanner 123 forms an electrostatic latent image corresponding to image information of a third color on the third photoconductor element 133, and the third developer 123 feeds toner of the third color to the electrostatic latent image. The fourth scanner 124 forms an electrostatic latent image corresponding to image information of a fourth color on the fourth photoconductor element 134, and the fourth developer 124 feeds toner of the fourth color to the electrostatic latent image.

The controller 160 includes an image forming controller 161 to control the light scanning unit 110 and the developing unit 120 in order to transfer test patterns to the intermediate transfer body 140, a pre-ACR (pre-Auto Color Registration) unit (162 to calculate fixed errors before printing, and a main-ACR (main-Auto Color Registration) unit 163 to calculate variable errors during printing, and to control scanning times in consideration of the fixed errors and the variable errors.

The test patterns transferred to the intermediate transfer body 140 are sensed by a sensing unit 150, and the pre-ACR unit 162 and the main-ACR unit 163 calculate fixed errors and variable errors based on the output value of the sensing unit 150. To do this, the sensing unit 150 is arranged at a predetermined location to sense test patterns for each color. An arrangement of the sensing unit 150 will be described with reference to FIG. 4.

Referring to FIG. 4, the sensing unit 150 may include one or more first sensing units 151 arranged between the first and second photoconductor elements 131 and 132, one or more second sensing units 152 arranged between the second and third photoconductor elements 132 and 133, one or more third sensing units 153 arranged between the third and fourth photoconductor elements 133 and 134, and one or more fourth sensing units 154 arranged after the fourth photosensitive element 134.

Figure 5A:
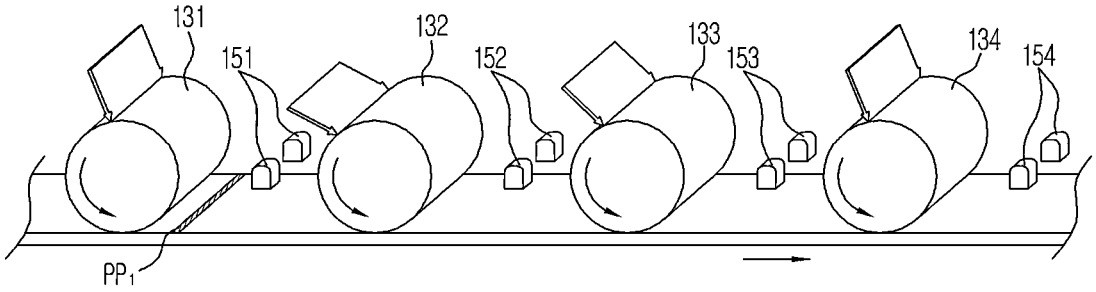
FIGS. 5A to 5D illustrate pre-test patterns transferred to an intermediate transfer body through pre-ACR (Auto Color Registration)

The first and second sensing units 151 and 152 include sensors for recognizing patterns. Each sensor may be an optical sensor consisting of a light-emitting unit to irradiate light toward the intermediate transfer body 140, and a light-receiving unit to receive light reflected from the intermediate transfer body 140. Since color registration of one end of the intermediate transfer body 140 in the width direction of the intermediate transfer body 140 may be different from that of the other end of the intermediate transfer body 140 due to scan skew of the light scanning unit 110, two sensors may be respectively arranged in both ends of the intermediate transfer body 140 as illustrated in FIG. 5A. However, the arrangement of sensors as illustrated in FIG. 5A is an example, and the sensors may be any sensors capable of recognizing patterns transferred to the intermediate transfer body 140. Also, each of the first to fourth sensing units 151 to 154 may include a sensor.

Each of the first to fourth sensing units 151 to 154 includes a counter to measure a time taken for a pattern of each color to be sensed by the corresponding sensor from when scanning onto the photoconductor element starts. Thereby, the sensing unit 150 may measure position errors between colors as times. However, counters are not necessarily included in sensors, and accordingly, the locations of the counters are not limited to the example of FIG. 4 or FIG. 8 which will be described later.

The image forming apparatus 100 performs pre-ACR before printing to calculate fixed errors of individual colors, performs main-ACR during printing to calculate variable errors, and controls scanning times in consideration of the fixed errors and the variable errors. Pre-ACR will be first described below.

The pre-ACR is performed before printing starts. By performing pre-ACR, an error of a light scanning position of a first scanner, an error of a rotation center position of each photoconductor element, and a color position error caused by an installation position error of each sensor are measured. The errors measured during pre-ACR are errors generated when elements are installed, or errors that always exist during printing. Accordingly, the errors measured during pre-ACR are referred to as fixed errors. Pre-ACR may be performed once after the image forming apparatus 100 is manufactured, after an element (for example, the light scanning unit 110, the photoconductor unit 130, or the intermediate transfer unit 140) of the image forming apparatus 100 is replaced with a new one, or when a pre-ACR execution command is received from a user. The user may input the pre-ACR command when it is expected that mechanical errors may be generated, for example, when a strong impact is applied to the image forming apparatus 100.

FIGS. 5A to 5D illustrate pre-test patterns transferred to the intermediate transfer body 140 through pre-ACR.

Referring to FIGS. 3 and 5A to 5D, in order to perform pre-ACR, the image forming controller 161 controls the light scanning unit 110 and the developing unit 120 to form pre-test patterns on individual photoconductor elements, and the pre-test patterns formed on the photoconductor elements are transferred to the intermediate transfer body 140.

The pre-test patterns are used to measure misregistration of colors, and may be any patterns capable of being recognized by the sensing unit 150.

Referring to FIG. 5A, if a pre-test pattern $PP_1$ of a first color is transferred from the first photoconductor element 131 to the intermediate transfer body 140, the first sensing units 151 sense the pre-test pattern $PP_1$ of the first color, and measure a time taken for the pre-test pattern $PP_1$ of the first color to be sensed from when scanning for forming the pre-test pattern $PP_1$ starts.

Figure 5B:
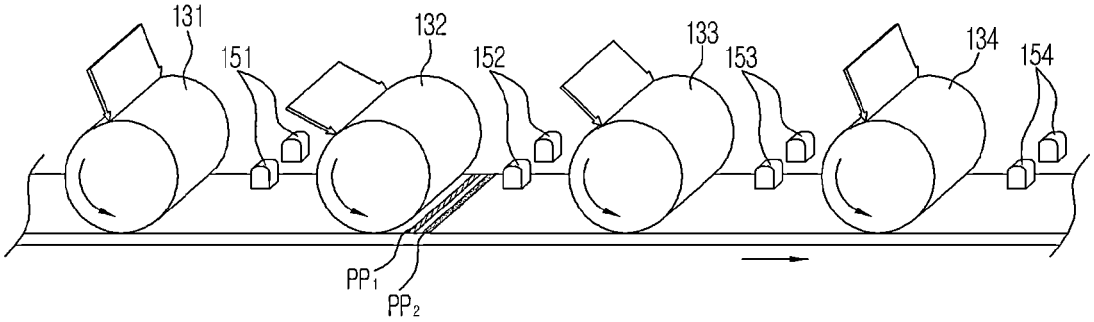

Referring to FIG. 5B, if a pre-test pattern $PP_2$ of a second color is transferred from the second photoconductor element 132 to the intermediate transfer body 140, the second sensing units 152 sense the pre-test pattern $PP_1$ of the first color and the pre-test pattern $PP_2$ of the second color, and measure times taken for the pre-test patterns $PP_1$ and $PP_2$ to be sensed from when scanning operations for forming the pre-test patterns $PP_1$ and $PP_2$ start.

Figure 5C:
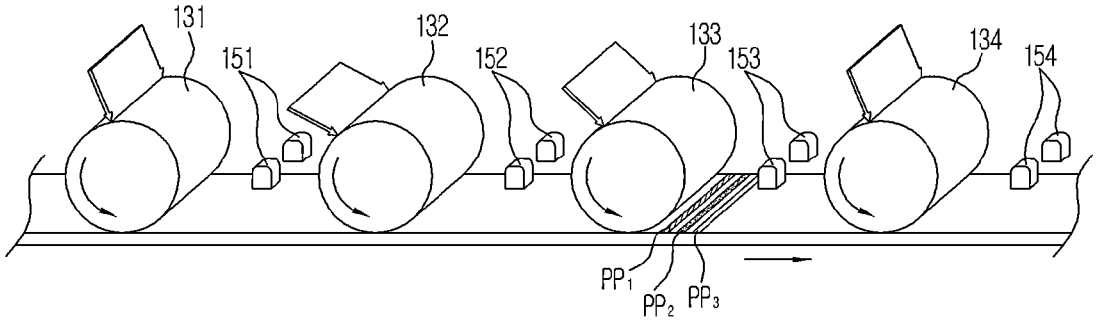

Referring to FIG. 5C, if a pre-test pattern $PP_3$ of a third color is transferred from the third photoconductor element 133 to the intermediate transfer body 140, the third sensing units 151 sense the pre-test patterns $PP_1$, $PP_2$, and $PP_3$ of the first, second, third colors, and measure times taken for the pre-test patterns $PP_1$, $PP_2$, and $PP_3$ to be sensed from when scanning operations for forming the pre-test patterns $PP_1$, $PP_2$, and $PP_3$ start.

Figure 5D:
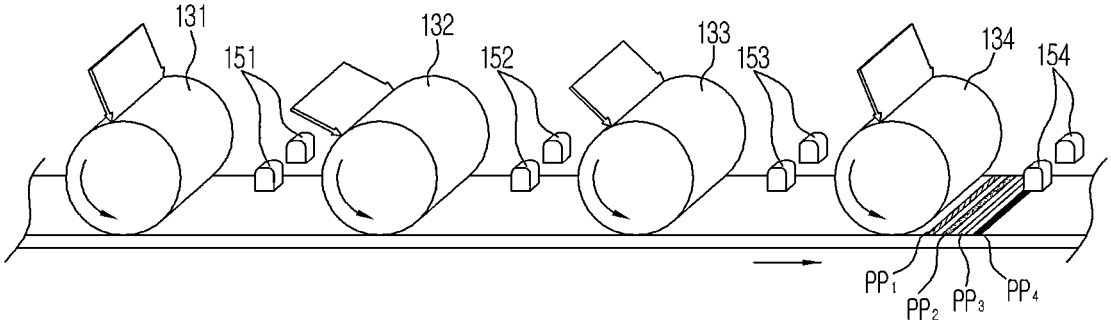

Referring to FIG. 5D, if a pre-test pattern $PP_4$ of a fourth color is transferred from the fourth photoconductor element 134 to the intermediate transfer body 140, the fourth sensing units 151 sense the pre-test patterns $PP_1$, $PP_2$, $PP_3$ and $PP_4$ of the first, second, third, and fourth colors, and measure times taken for the pre-test patterns $PP_1$, $PP_2$, $PP_3$ and $PP_4$ to be sensed from when scanning operations for forming the pre-test patterns $PP_1$, $PP_2$, $PP_3$ and $PP_4$ start.

Referring again to FIG. 4, a distance from the rotation center of the first photoconductor element 131 to the rotation center of the second photoconductor element 132 is referred to as $X_{O2}$, a distance from the rotation center of the first photoconductor element 131 to the rotation center of the third photoconductor element 133 is referred to as $X_{O3}$, and a distance from the rotation center of the first photoconductor element 131 to the rotation center of the fourth photoconductor element 134 is referred to as $X_{O4}$.

Also, a distance from the rotation center of the first photoconductor element 131 to the first sensing units 151 is referred to as $X_{S1}$, a distance from the rotation center of the first photoconductor element 131 to the second sensing units 152 is referred to as $X_{S2}$, a distance from the rotation center of the first photoconductor element 131 to the third sensing units 153 is referred to as $X_{S3}$, and a distance from the rotation center of the first photoconductor element 131 to the fourth sensing units 154 is referred to as $X_{S4}$.

Also, angles of scanning positions of the photoconductor elements 131 to 134 with respect to a transfer position on the intermediate transfer body 140 are respectively referred to as $\theta_1$, $\theta_2$, $\theta_3$, and $\theta_4$, angular velocities of rotation of the photoconductor elements 131 to 134 are respectively referred to as $W_1$, $W_2$, $W_3$, and $W_4$, and a movement speed of the intermediate transfer body 140 is referred to as Vb.

The above-mentioned values are design values, and a design time $T_{ij}$ taken for an image developed on an i-th photoconductor drum to be transferred to the intermediate transfer body 140 and sensed by j-th sensing units from when scanning onto the i-th photoconductor drum starts may be expressed by Equation (1), below.

$$T_{ij}=(X_{Sj}-X_{Oi})/Vb+\theta_i/W_i \tag{1}$$

When i is 1, $X_{Oi}$ is zero. However, since an actual measurement value $PT_{ij}$ includes a scanning position error $\delta\theta_i$, a rotation center position error $\delta X_{Oi}$ of a photoconductor element, and a position error $\delta X_{Sj}$ of a sensing unit, there is a difference between a design time and an actual measurement time $PT_{ij}$. The difference may be expressed by Equation (2), below.

$$Y_1=PT_{11}-T_{11}=\delta Xs_1/Vb+\delta\theta_1/W_1$$

$$Y_2=PT_{12}-T_{12}=\delta Xs_2/Vb+\delta\theta_1/W_1$$

$$Y_3=PT_{13}-T_{13}=\delta Xs_3/Vb+\delta\theta_1/W_1$$

$$Y_4=PT_{14}-T_{14}=\delta Xs_4/Vb+\delta\theta_1/W_1$$

$$Y_5=PT_{24}-T_{24}=(\delta Xs_4-\delta Xo_2)/Vb+\delta\theta_2/W_2$$

$$Y_6=PT_{34}-T_{34}=(\delta Xs_4-\delta Xo_3)/Vb+\delta\theta_3/W_3$$

$$Y_7=PT_{44}-T_{44}=(\delta Xs_4-\delta Xo_4)/Vb+\delta\theta_4/W_4$$

$$Y_8=PT_{22}-T_{22}=(\delta Xs_2-\delta Xo_2)/Vb+\delta\theta_2/W_2$$

$$Y_9=PT_{33}-T_{33}=(\delta Xs_3-\delta Xo_3)/Vb+\delta\theta_3/W_3$$

$$Y_{10}=PT_{23}-T_{23}=(\delta Xs_3-\delta Xo_2)/Vb+\delta\theta_2/W_2 \tag{2}$$

Errors represented as time differences by Equation (2) are position errors between colors, and when the linear velocity of the intermediate transfer body 140 is different from the surface velocity of the photoconductor elements 131 to 134, the position errors between the colors may be expressed by Equation (3), below.

$$X_1=\delta Xo_2/Vb+\delta\theta_1/W_1-\delta\theta_2/W_2$$

$$X_2=\delta Xo_3/Vb+\delta\theta_1/W_1-\delta\theta_3/W_3$$

$$X_3=\delta Xo_4/Vb+\delta\theta_1/W_1-\delta\theta_4/W_4 \tag{3}$$

In Equation (3), $X_1$ is a time value when a position error of a second color with respect to a first color is expressed as a time, $X_2$ is a time value when a position error of a third color with respect to the first color is expressed as a time, and $X_3$ is a time value when a position error of a fourth color with respect to the first color is expressed as a time.

Referring to Equations (2) and (3), $X_1$, $X_2$, and $X_3$ can be obtained using $Y_4$ through $Y_7$, relationships between these variables may be expressed by Equation (4), and $X_1$, $X_2$, and $X_3$ are fixed errors calculated by the pre-ACR unit 162.

$$X_1=Y_4-Y_5$$

$$X_2=Y_4-Y_6$$

$$X_3=Y_4-Y_7 \tag{4}$$

In addition, $X_4$, $X_5$, $X_6$, and $X_7$ may be expressed by Equation (5), below, and relationships between $X_1$ to $X_7$ and $Y_1$ to $Y_7$ may be expressed as a matrix of Equation (6), below.

$$\begin{aligned} X_4 &= \delta Xs_1/Vb+\delta\theta_1/W_1 \\ X_5 &= (\delta Xs_2-\delta Xo_2)/Vb+\delta\theta_2/W_2 \\ X_6 &= (\delta Xs_3-\delta Xo_3)/Vb+\delta\theta_3/W_3 \\ X_7 &= (\delta Xs_4-\delta Xo_4)/Vb+\delta\theta_4/W_4 \end{aligned} \tag{5}$$

$$\begin{bmatrix} X_1 \\ X_2 \\ X_3 \\ X_4 \\ X_5 \\ X_6 \\ X_7 \end{bmatrix} = A \begin{bmatrix} Y_1 \\ Y_2 \\ Y_3 \\ Y_4 \\ Y_5 \\ Y_6 \\ Y_7 \end{bmatrix}, \tag{6}$$

$$A = \begin{bmatrix} 0 & 0 & 0 & 1 & -1 & 0 & 0 \\ 0 & 0 & 0 & 1 & 0 & -1 & 0 \\ 0 & 0 & 0 & 1 & 0 & 0 & -1 \\ 1 & 0 & 0 & 0 & 0 & 0 & 0 \\ 0 & 1 & 0 & -1 & 1 & 0 & 0 \\ 0 & 0 & 1 & -1 & 0 & 1 & 0 \\ 0 & 0 & 0 & 0 & 0 & 0 & 1 \end{bmatrix}$$

As described above, in order for the pre-ACR unit 162 to calculate fixed errors, times $PT_{14}$, $PT_{24}$, $PT_{34}$, and $PT_{44}$ taken for the pre-test patterns $PP_1$ to $PP_4$ of the first to fourth colors to respectively arrive at the fourth sensing unit 154 should be measured, and design times $T_{14}$, $T_{24}$, $T_{34}$, and $T_{44}$ for the times $PT_{14}$, $PT_{24}$, $PT_{34}$, and $PT_{44}$ also should be calculated.

The pre-ACR unit 162 may perform only calculations required to calculate fixed errors among calculations of Equations (1) to (6), or the sensing unit 150 may also measure only times needed to calculate fixed errors. However, in this exemplary embodiment, the sensing unit 150 measures a time $PT_{11}$ taken for the pre-test pattern $PP_1$ of the first color to arrive at the first sensing units 151, a time $PT_{22}$ taken for the pre-test pattern $PP_2$ of the second color to arrive at the second sensing units 152, and a time $PT_{33}$ taken for the pre-test pattern $PP_3$ of the third color to arrive at the third sensing units 153, so that the times $PT_{11}$, $PT_{22}$, and $PT_{33}$ can be used for main-ACR which will be next performed.

Thereafter, when a print command is input, the main-ACR unit 163 performs main-ACR while performing printing.

Figure 6:
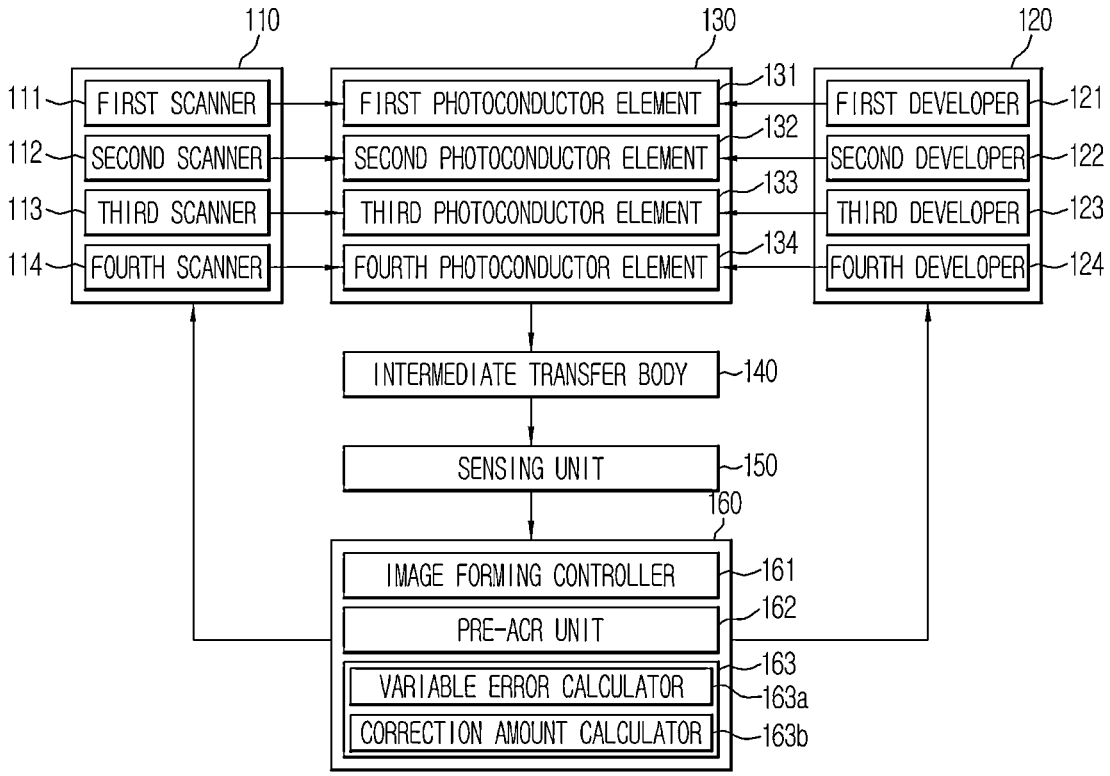
FIG. 6 is a control block diagram of a main-ACR unit according to an exemplary embodiment.
Figure 7A:
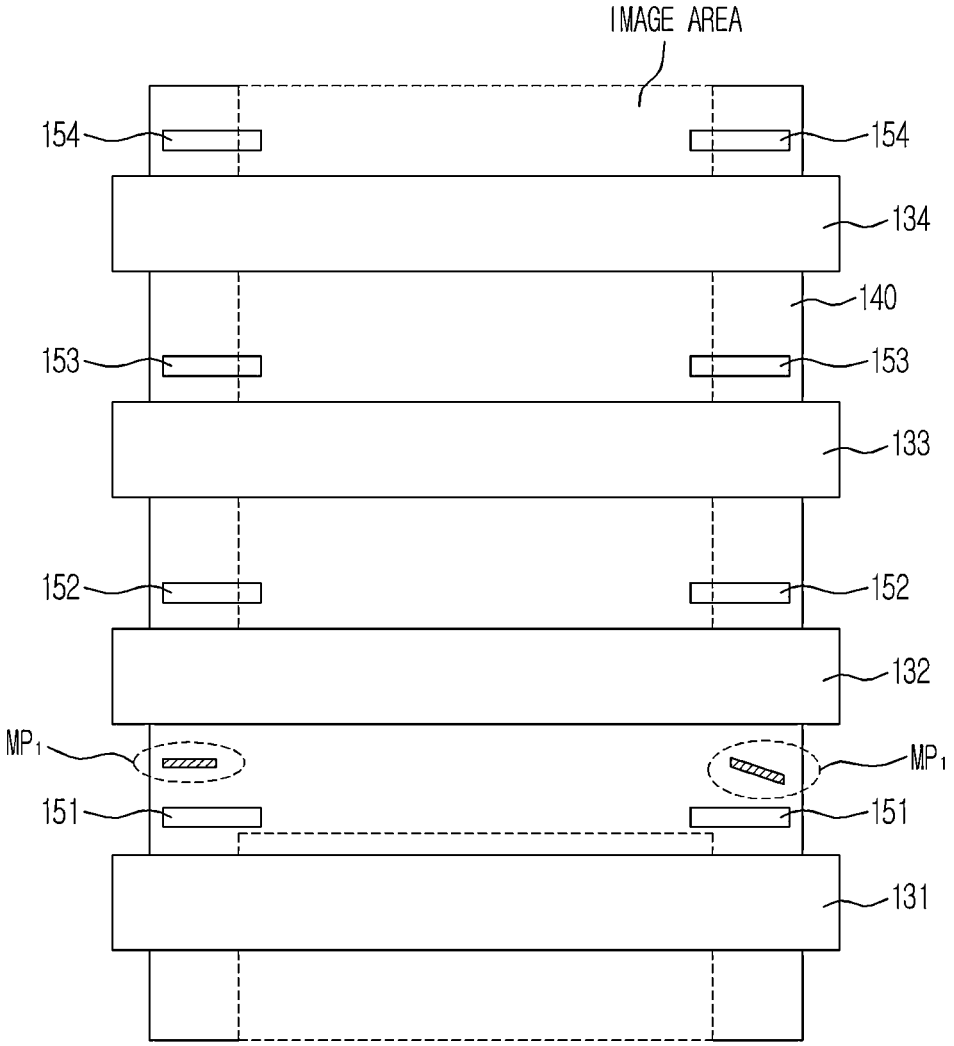
FIGS. 7A to 7C illustrate main-test patterns transferred to an intermediate transfer body.
Figure 7B:
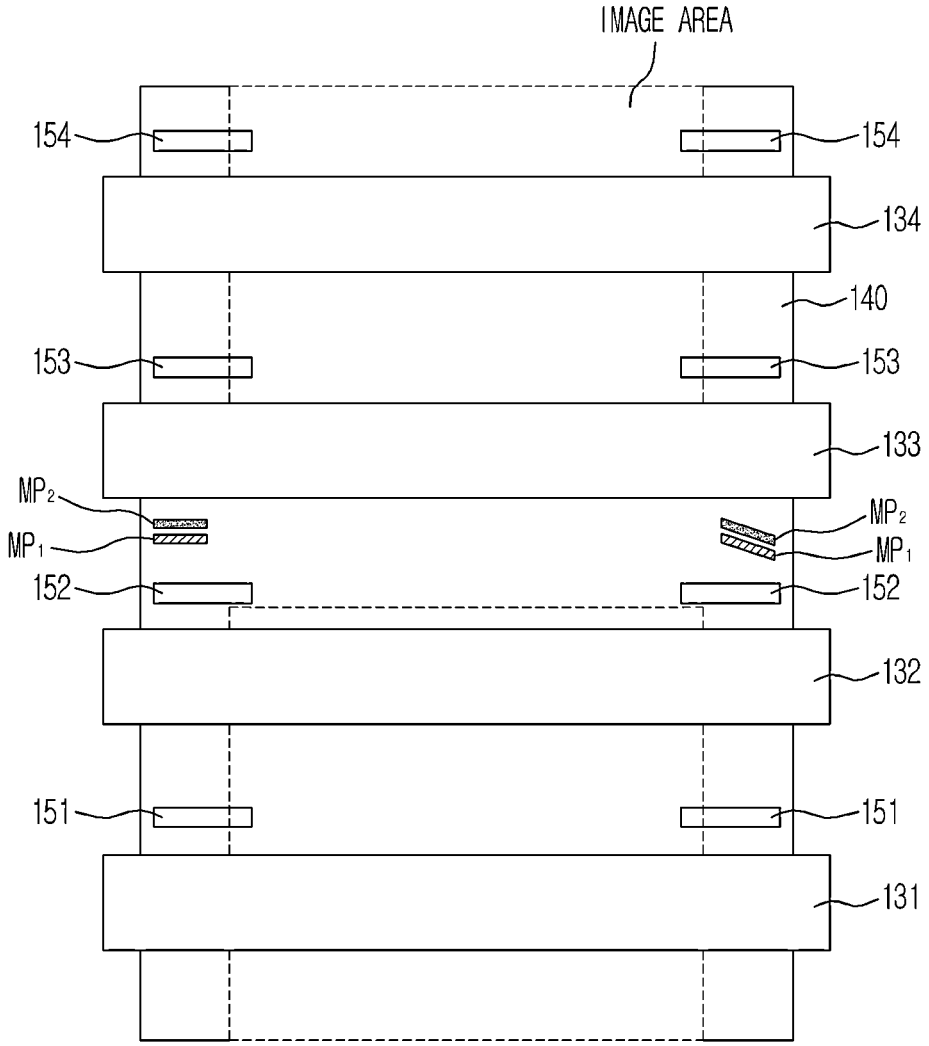
Figure 7C:
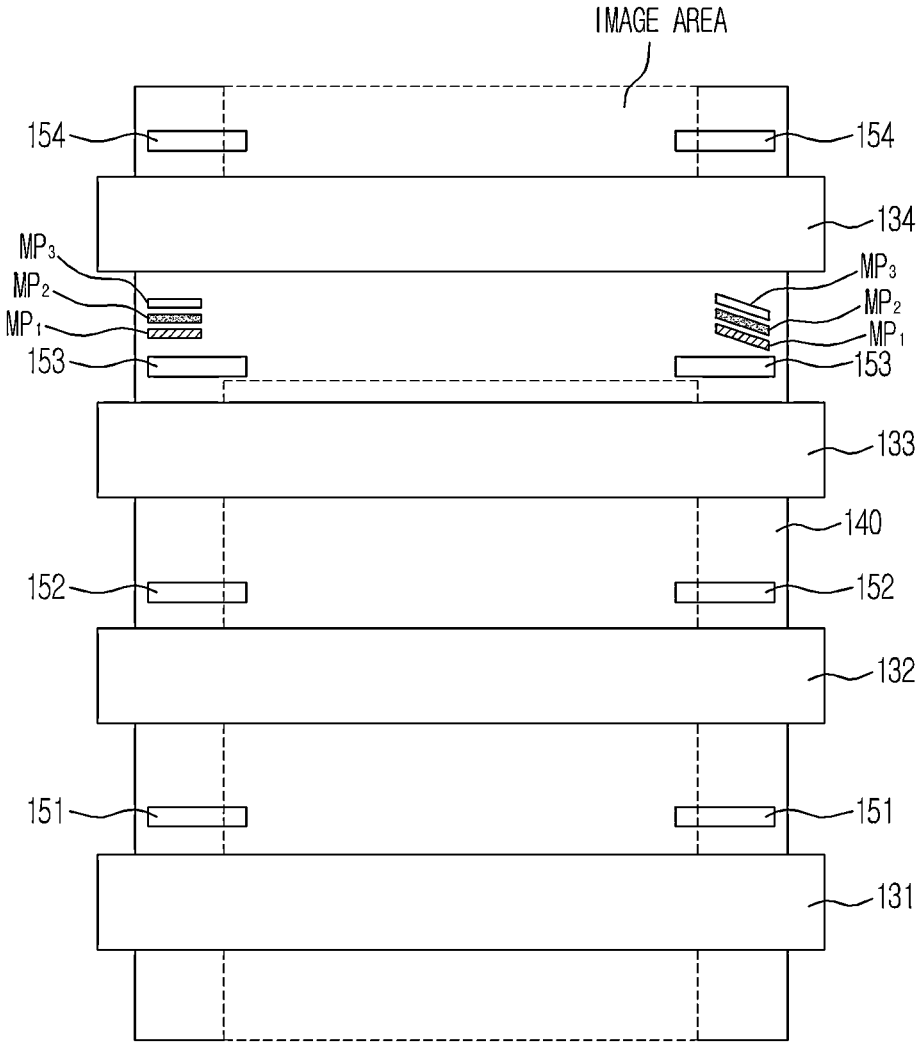

FIG. 6 is a control block diagram of the main-ACR unit 163 according to an exemplary embodiment, and FIGS. 7A to 7C illustrate main-test patterns transferred to the intermediate transfer body 140. FIGS. 7A to 7C show the intermediate transfer body 140 as seen from the top.

During printing, due to various factors, such as a change in velocity of the intermediate transfer body 150 according to the amount of consumed toner, an increase of inner temperature of the image forming apparatus 100 (see FIG. 2), and the like, additional errors, that is, variable errors other than fixed errors calculated during pre-ACR may be generated. Referring to FIG. 6, the main-ACR unit 163 includes a variable error calculator 163*a* to calculate variable errors, and a correction amount calculator 163*b* to calculate correction amounts in order to adjust scanning times in consideration of fixed errors and variable errors.

When a print command is received, the image forming controller 161 starts printing, and simultaneously causes main-test patterns to be transferred to non-image areas, as illustrated in FIGS. 7A, 7B, and 7C. The non-image areas may be areas between paper sheets that are successively delivered, or areas out of the width of paper. That is, the non-image areas may be any areas that are not supposed to have any print on them.

Referring to FIG. 7A, if main-test patterns $MP_1$ of a first color are transferred to the intermediate transfer body 140, the first sensing units 151 sense the main-test patterns $MP_1$, and measure a time $MT_{11}$ taken for the main-test patterns $MP_1$ to be sensed from when scanning starts. Then, the variable error calculator 163*a* calculates a difference (that is, a variable error $Z_1$) between the measured time $MT_{11}$ and the time $PT_{11}$ measured during pre-ACR. Successively, the correction amount calculator 163*b* adds the variable error $Z_1$ to the fixed error $X_1$ calculated during pre-ACR to calculate a correction amount, and the image forming controller 161 adjusts a scanning time of a second color according to the correction amount. Then, scanning for forming main-test patterns $MP_2$ of a second color is performed together with scanning for printing.

Referring to FIG. 7B, if the main-test patterns $MP_2$ of the second color are transferred to the intermediate transfer body 140, the second sensing units 152 sense the main-test patterns $MP_2$, and measure a time $MT_{22}$ taken for the main-test patterns $MP_2$ to be sensed from when scanning starts. Then, the variable error calculator 163*a* calculates a difference (that is, a variable error $Z_2$) between the measured time $MT_{22}$ and the time $PT_{22}$ measured during pre-ACR. Successively, the correction amount calculator 163*b* adds the variable error $Z_2$ to the fixed error $X_2$ calculated during pre-ACR to calculate a correction amount, and the image forming controller 161 adjusts a scanning time of a third color according to the correction amount. Alternatively, the correction amount calculator 163*b* may add an average value of the variable error $Z_1$ of the first color and the variable error $Z_2$ of the second color, to the fixed error $X_2$, or the correction amount calculator 163*b* may add the variable errors $Z_1$ and $Z_2$ after applying weights to the variable errors $Z_1$ and $Z_2$, and add the added value to the fixed error $X_2$.

Referring to FIG. 7C, if main-test patterns $MP_3$ of a third color are transferred to the intermediate transfer body 140, the third sensing units 153 sense the main-test patterns $MP_3$, and measure a time $MT_{33}$ taken for the main-test patterns $MP_3$ to be sensed from when scanning starts. Then, the variable error calculator 163*a* calculates a difference (that is, a variable error $Z_3$) between the measured time $MT_{33}$ and the time $PT_{33}$ measured during pre-ACR. Successively, the correction amount calculator 163*b* adds the variable error $Z_3$ to the fixed error $X_3$ calculated during pre-ACR to calculate a correction amount, and the image forming controller 161 adjusts a scanning time of a fourth color according to the correction amount. Alternatively, the correction amount calculator 163*b* may add an average value of the variable error $Z_2$ of the first color, the variable error $Z_2$ of the second color, and the variable error $Z_3$ of the third color to the fixed error $X_3$, or the correction amount calculator 163*b* may add the variable errors $Z_1$, $Z_2$, and $Z_3$ after applying weights to the variable errors $Z_1$, $Z_2$, and $Z_3$ and add the added value to the fixed error $X_3$.

Embodiments for ACR of the image forming apparatus 100 will be described in detail based on the above descriptions.

In the following description of an example of an embodiment, it is assumed that elements installed in the image forming apparatus 100 have specific conditions as follows.

A diameter d of each of the first to fourth photoconductor elements 131 to 134 is 30 mm, angular velocity ω of each of the first to fourth photoconductor elements 131 to 134 is 6.7 rad/s (64 rpm), linear velocity Vb of the intermediate transfer body 140 is 100 mm/s, and a design value of a distance between the rotation centers of two neighboring photoconductor elements is 73 mm.

With regard to distances between the rotation centers of actually installed photoconductor elements, it is assumed that a distance $X_{O2}$ from the rotation center of the first photoconductor element 131 to the rotation center of the second photoconductor element 132 is 73.3 mm, a distance $X_{O3}$ from the rotation center of the first photoconductor element 131 to the rotation center of the third photoconductor element 133 is 146.2 mm, and a distance $X_{O4}$ from the rotation center of the first photoconductor element 131 to the rotation center of the fourth photoconductor element 134 is 219.5 mm.

Also, a design distance $X_{S1}$ from the rotation center of the first photoconductor element 131 to the first sensing units 151 is 30 mm, a design distance $X_{S2}$ from the rotation center of the first photoconductor element 131 to the second sensing units 152 is 108 mm, a design distance $X_{S3}$ from the rotation center of the first photoconductor element 131 to the third sensing units 153 is 186 mm, and a design distance $X_{S4}$ from the rotation center of the first photoconductor element 131 to the fourth sensing units 154 is 264 mm.

A distance error $\delta X_{S1}$ from the rotation center of the first photoconductor element 131 to the first sensing units 151 is 0.1 mm, a distance error $\delta X_{S2}$ from the rotation center of the first photoconductor element 131 to the second sensing units 152 is −0.1 mm, a distance error $\delta X_{S3}$ from the rotation center of the first photoconductor element 131 to the third sensing units 153 is 0.2 mm, and a distance error $\delta X_{S4}$ from the rotation center of the first photoconductor element 131 to the fourth sensing units 154 is −0.2 mm.

Also, a design angle θ of the scanning position of each photoconductor element 131 through 134 with respect to a transfer position on the intermediate transfer body 140 is 2.5 rad.

It is assumed that a degree by which the scanning position of the first photoconductor 131 is deviated, that is, a scanning position error $\delta\theta_1$ of the first photoconductor 131 is 0.01 rad, a scanning position error $\delta\theta_2$ of the second photoconductor 132 is 0.00 rad, a scanning position error $\delta\theta_3$ of the third photoconductor 133 is −0.02 rad, and a scanning position error $\delta\theta_4$ of the fourth first photoconductor 134 is 0.03 rad.

The image forming controller 161 transfers pre-test patterns of colors to the intermediate transfer body 140, and the first to fourth sensing units 151 to 154 sense the pre-test patterns of the colors, respectively, to measure times $PT_{ij}$. Actual measurement times $PT_{ij}$ estimated using Equations (1) and (2) are $PT_{11}$=675.6 ms, $PT_{14}$=3012.6 ms, $PT_{24}$=2278.1 ms, $PT_{34}$=1546.1 ms, $PT_{44}$=820.6 ms, $PT_{22}$=719.1 ms, and $PT_{33}$=770.1 ms.

The pre-ACR unit 162 can calculate design times $T_{ij}$ using Equation (1), and the calculated design times $T_{ij}$ are $T_{11}$=673.1 ms, $T_{14}$=3013.1 ms, $T_{24}$=2283.1 ms, $T_{34}$=1553.1 ms, $T_{44}$=823.1 ms, $T_{22}$=723.1 ms, and $T_{33}$=773.1 ms.

The pre-ACR unit 162 can calculate differences between the measurement times $PT_{ij}$ and the design times $T_{ij}$. The calculated differences are $Y_4$=−0.5, $Y_5$=−5.0 ms, $Y_6$=−7.0 ms, and $Y_7$=−2.5 ms. The pre-ACR unit 162 applies the calculated differences to Equation (4) to calculate fixed errors. The fixed errors are calculated as $X_1$=4.5 ms, $X_2$=6.5 ms, and $X_3$=2.0 ms.

After fixed errors are calculated, pre-ACR terminates, and the image forming apparatus 100 enters a print standby state. Thereafter, when a print command is received, printing is performed, and simultaneously main-ACR is performed. If the image forming controller 161 transfers main-test patterns $MP_1$ of a first color to non-image areas of the intermediate transfer body 140, the first sensing units 151 sense the transferred main-test patterns $MP_1$ of the first color, and measure a time $MT_{11}$ taken for the main-test patterns $MP_1$ to be sensed from when scanning starts.

The measured time $MT_{11}$ may be different from the time $PT_{11}$ measured during pre-ACR due to a change in inner temperature of the image forming apparatus 100, an impact from the outside, or the like. If the measured time $MT_{11}$ is 673.6 ms, a first error $Z_1$ calculated by the variable error calculator 163*a* is −2 ms resulting from subtracting the time $MT_{11}$ measured during main-ACR from the time $PT_{11}$ measured during pre-ACR.

The correction amount calculator 163*b* adds the fixed error $X_1$ (4.5 ms) of the second color with respect to the first color to the first variable error $Z_1$ to calculate a correction amount of 2.5 ms, and accordingly, the image forming controller 161 delays a scanning time of the second color by 2.5 ms.

Then, if the image forming controller 161 transfers main-test patterns $MP_2$ of the second color to the non-image areas of the intermediate transfer body 140, the second sensing units 152 sense the main-test patterns $MP_2$ to measure a time $MT_{22}$ taken for the main-test patterns $MP_2$ to be sensed from when scanning starts. If the measured time $MT_{22}$ is 716.9 ms, a second error $Z_2$ calculated by the variable error calculator 163*a* is −2.2 ms, and a correction amount calculated by the correction amount calculator 163*b* is 4.3 ms resulting from adding the second variable error $Z_2$ to the fixed error $X_2$ (6.5 ms) of the third color with respect to the first color. Accordingly, the image forming controller 161 delays a scanning time of the third color by 4.3 ms.

Then, if the image forming controller 161 transfers main-test patterns $MP_3$ of the third color to the non-image areas of the intermediate transfer body 140, the third sensing units 153 sense the main-test patterns $MP_3$ to measure a time $MT_{33}$ taken for the main-test patterns $MP_3$ to be sensed from when scanning starts. If the measured time $MT_{33}$ is 763.1 ms, a third variable error $Z_3$ calculated by the variable error calculator 163*a* is −7.0 ms, and a correction amount calculated by the correction amount calculator 163*b* is −5.0 ms resulting from adding the third variable error $Z_3$ to the fixed error $X_3$ (2.0 ms) of the fourth color with respect to the first color. Accordingly, the image forming controller 161 scans the fourth color earlier by 5.0 ms.

The main-ACR unit 163 may perform main-ACR whenever printing is performed, and since a scanning time of each color is corrected in real time, color misregistration may be prevented in advance.

Figure 8:
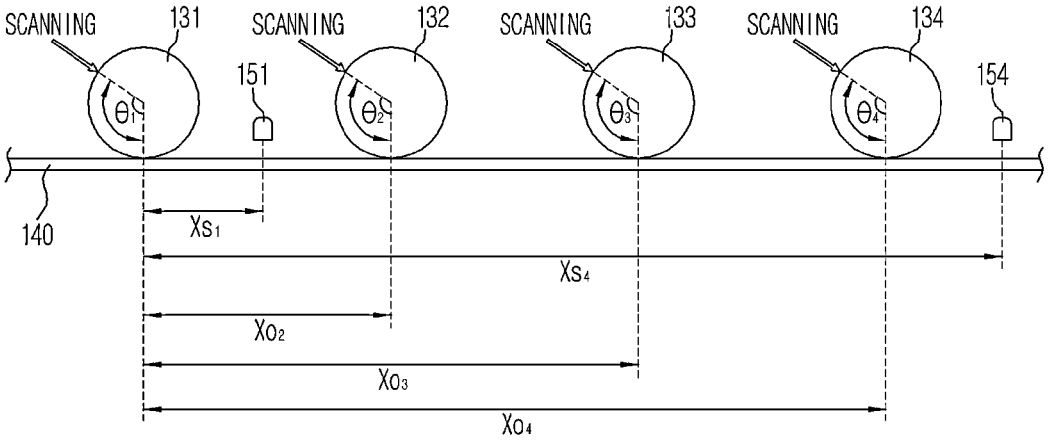
FIG. 8 illustrates an arrangement of sensing units in an image forming apparatus having two sensing units, according to an exemplary embodiment.
Figure 9A:
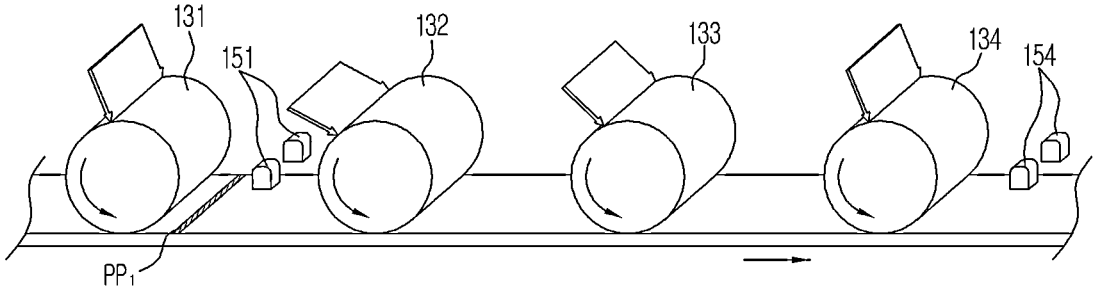
FIGS. 9A to 9D illustrate pre-test patterns transferred to an intermediate transfer body through pre-ACR.
Figure 9B:
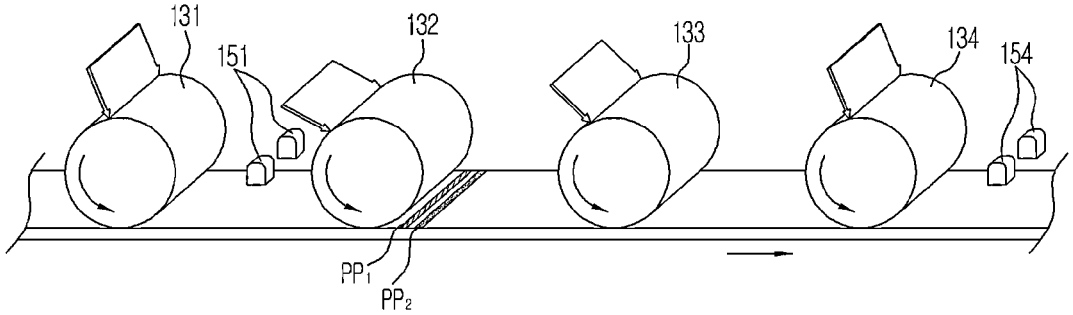
Figure 9C:
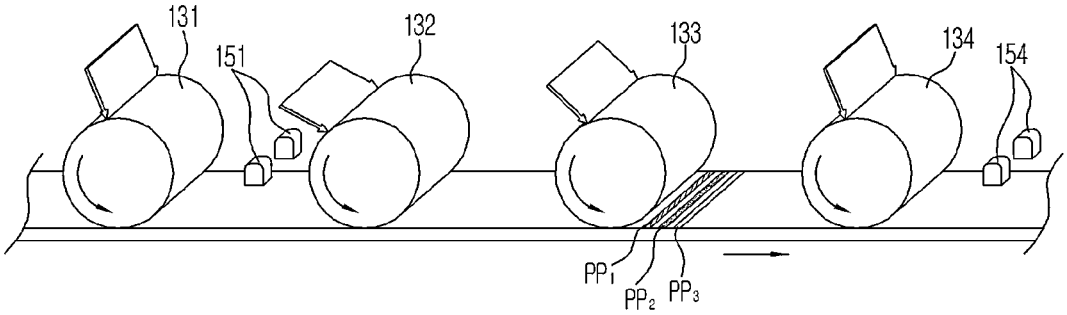
Figure 9D:
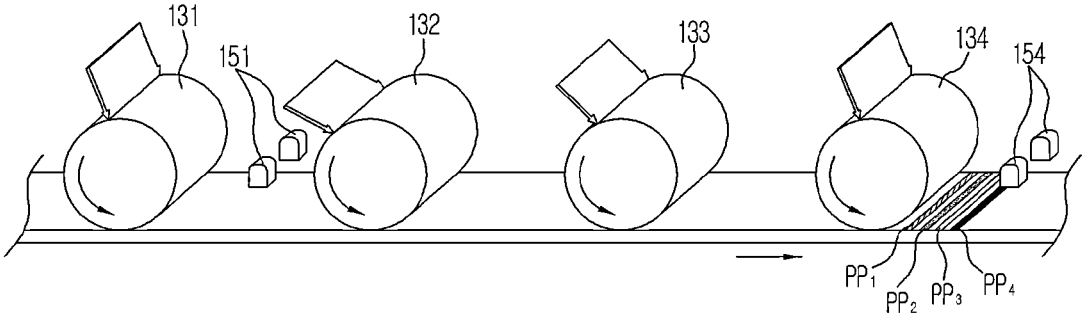

FIG. 8 illustrates an arrangement of sensing units in an image forming apparatus having two sensing units, according to an exemplary embodiment.

Exemplary embodiments described above relate to the case in which one or more sensing units are arranged every photoconductor element, however, in the case in which misregistrations of colors are continuously generated, only a variable error $Z_1$ of a first color may be calculated during main-ACR. Accordingly, as illustrated in FIG. 8, although only first sensing units 151 and fourth sensing units 154 are provided, scanning times can be controlled through pre-ACR and main-ACR.

FIGS. 9A to 9D illustrate pre-test patterns transferred to the intermediate transfer body 140 through pre-ACR.

Referring to FIGS. 9A to 9D, when the first and fourth sensing units 151 and 154 are provided without the second and third sensing units 152 and 153, pre-test patterns of first to fourth colors are transferred to the intermediate transfer body 140, and a time $PT_{11}$ taken for a pre-test pattern $PP_1$ of the first color to arrive at the first sensing units 151 from when scanning starts, a time $PT_{14}$ taken for the pre-test pattern $PP_1$ of the first color to arrive at the fourth sensing units 154, a time $PT_{24}$ taken for a pre-test pattern $PP_2$ of the second color to arrive at the fourth sensing units 154 from when scanning starts, a time $PT_{34}$ taken for a pre-test pattern $PP_3$ of the third color to arrive at the fourth sensing units 154 from when scanning starts, and a time $PT_{44}$ taken for a pre-test pattern $PP_4$ of the fourth color to arrive at the fourth sensing units 154 from when scanning starts are measured.

Referring again to FIG. 8, a distance from the rotation center of the first photoconductor element 131 to the rotation center of the second photoconductor element 132 is referred to as $X_{O2}$, a distance from the rotation center of the first photoconductor element 131 to the rotation center of the third photoconductor element 133 is referred to as $X_{O3}$, and a distance from the rotation center of the first photoconductor element 131 to the rotation center of the fourth photoconductor element 134 is referred to as $X_{O4}$.

A distance from the rotation center of the first photoconductor element 131 to the first sensing units 151 is referred to as $X_{S1}$, and a distance from the rotation center of the first photoconductor element 131 to the fourth sensing units 151 is referred to as $X_{S1}$.

The pre-ACR unit 162 calculates fixed errors $X_1$, $X_2$, and $X_3$ using Equations (1) through (4), as described above. More specifically, the pre-ACR unit 162 calculates reference times $T_{ij}$, which are design values, using Equation (1). Then, pre-ACR unit 162 calculates differences between the reference times $T_{ij}$ and measurement times $PT_{ij}$ using Equation (2). At this time, the pre-ACR unit 162 may calculate $Y_4$ through $Y_7$ as the differences between the reference times $T_{ij}$ and the measurement times $PT_{ij}$, since neither second sensing units nor third sensing units are used. Then, the pre-ACR unit 162 applies $Y_4$ through $Y_7$ to Equation (4) to thereby calculate a fixed error $X_1$ of a second color, a fixed error $X_2$ of a third color, and a fixed error $X_3$ of a fourth color with respect to the first color.

Thereafter, when a print command is received, the main-ACR unit 163 performs main-ACR while performing printing. When only the first and fourth sensing units 151 and 154 are provided as in an embodiment of FIG. 8 and a print command is received, the image forming controller 161 causes main-test patterns of a first color to be transferred to non-image areas of the intermediate transfer body 140.

Figure 10:
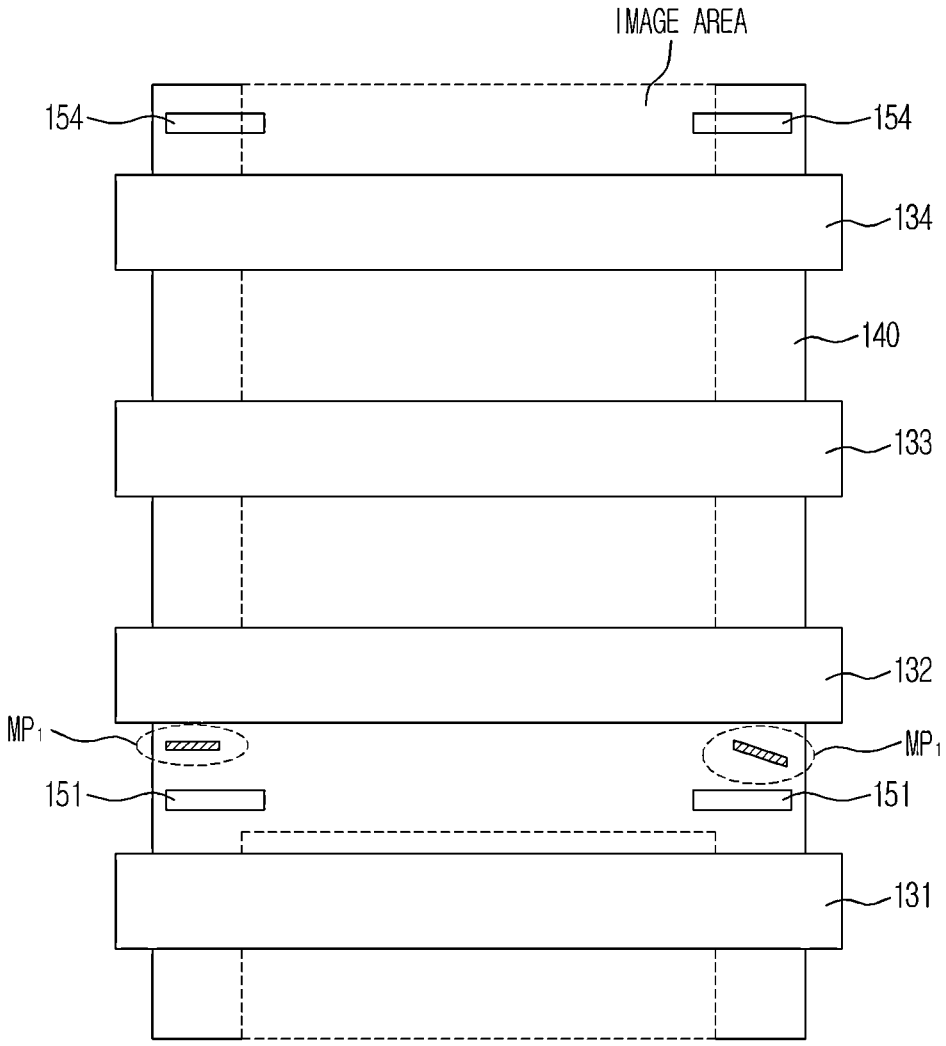
FIG. 10 illustrates main-test patterns transferred to an intermediate transfer body.

FIG. 10 illustrates main-test patterns transferred to the intermediate transfer body 140. FIG. 10 shows the intermediate transfer body 140 as seen from the top.

In this exemplary embodiment, main-ACR may be performed although only main-test patterns $MP_1$ of a first color are transferred to the intermediate transfer body 140.

More specifically, if main-test patterns $MP_1$ of a first color are transferred to the intermediate transfer body 140, the first sensing units 151 sense the main-test patterns $MP_1$ of the first color, and measure a time $MT_{11}$ taken for the main-test patterns $MP_1$ to be sensed from when scanning starts. Then, the variable error calculator 163*a* calculates a difference between the time $MT_{11}$ measured during main-ACR and a time $PT_{11}$ measured during pre-ACR to obtain a variable error $Z_1$.

Successively, the correction amount calculator 163*b* adds the variable error $Z_1$ to fixed errors of individual colors to calculate correction amounts. That is, a correction amount of a second color is calculated as $X_1+Z_1$, a correction amount of a third color is calculated as $X_2+Z_1$, and a correction amount of a fourth color is calculated as $X_3+Z_1$. That is, after a first color is scanned, the main-ACR unit 163 calculates correction amounts of second, third, and fourth colors following the first color, and adjusts scanning times of the second, third, and fourth colors based on the calculated correction amounts when the second, third, and fourth colors are scanned. More specifically, the second color is scanned after a delay time of $X_1+Z_1$ elapses, the third color is scanned after a delay time of $X_2+Z_1$ elapses, and the fourth color is scanned after a delay time of $X_3+Z_1$ elapses. When the sign of a correction amount is positive (+), scanning may be delayed, and when the sign of a correction amount is negative (−), scanning may be performed earlier. However, when the sign of a correction amount is negative (−), scanning may be delayed, and if the sign of a correction amount is positive (+), scanning may be performed earlier.

An ACR of the image forming apparatus 100 having two sensing units will be described in detail based on the above descriptions.

In the following description, it is assumed that elements installed in the image forming apparatus 100 have specific conditions as follows.

A diameter d of each of the first to fourth photoconductor elements 131 to 134 is 30 mm, angular velocity w of each of the first to fourth photoconductor elements 131 to 134 is 6.7 rad/s (64 rpm), linear velocity Vb of the intermediate transfer body 140 is 100 mm/s, and a design value of a rotation center distance between two neighboring photoconductor elements is 73 mm.

With regard to distances between the rotation centers of actually installed photoconductor elements, it is assumed that a distance $X_{O2}$ from the rotation center of the first photoconductor element 131 to the rotation center of the second photoconductor element 132 is 73.3 mm, a distance $X_{O3}$ from the rotation center of the first photoconductor element 131 to the rotation center of the third photoconductor element 133 is 146.2 mm, and a distance $X_{O4}$ from the rotation center of the first photoconductor element 131 to the rotation center of the fourth photoconductor element 134 is 219.5 mm.

Also, a design distance $X_{S1}$ from the rotation center of the first photoconductor element 131 to the first sensing units 151 is 30 mm, and a design distance $X_{S4}$ from the rotation center of the first photoconductor element 131 to the fourth sensing units 154 is 264 mm.

A distance error $\delta X_{S1}$ from the rotation center of the first photoconductor element 131 to the first sensing units 151 is 0.1 mm, and a distance error $\delta X_{S4}$ from the rotation center of the first photoconductor element 131 to the fourth sensing units 154 is −0.2 mm.

Also, a design angle θ of the scanning position of each photoconductor element 131 and 134 with respect to a transfer position on the intermediate transfer body 140 is 2.5 rad.

It is assumed that a degree by which the scanning position of the first photoconductor 131 is deviated, that is, a scanning position error $\delta\theta_1$ of the first photoconductor 131 is 0.01 rad, a scanning position error $\delta\theta_2$ of the second photoconductor 132 is 0.00 rad, a scanning position error $\delta\theta_3$ of the third photoconductor 133 is −0.02 rad, and a scanning position error $\delta\theta_4$ of the fourth first photoconductor 134 is 0.03 rad.

Pre-ACR may be performed when an error may be generated in an element installed in the image forming apparatus 100, for example, after the image forming apparatus 100 is manufactured, after an element of the image forming apparatus 100 is replaced with a new one, or when an impact from the outside is applied to the image forming apparatus 100. In order to perform pre-ACR, the image forming controller 161 transfers pre-test patterns of individual colors to the intermediate transfer body 140, and the first sensing units 151 and the fourth sensing units 154 sense the pre-test patterns of the colors to measure times $PT_{ij}$.

Actual measurement times $PT_{ij}$ estimated using Equations (1) and (2) are $PT_{11}$=675.6 ms, $PT_{14}$=3012.6 ms, $PT_{24}$=2278.1 ms, $PT_{34}$=1546.1 ms, and $PT_{44}$=820.6 ms.

The pre-ACR unit 162 can calculate design times $T_{ij}$ using Equation (1), and the calculated design times $T_{ij}$ are $T_{11}$=673.1 ms, $T_{14}$=3013.1 ms, $T_{24}$=2283.1 ms, $T_{34}$=1553.1 ms, and $T_{44}$=823.1 ms.

Then, the pre-ACR unit 162 calculates differences between the measurement times $PT_{ij}$ and the design times $T_{ij}$. The calculated differences are $Y_4$=−0.5, $Y_5$=−5.0 ms, $Y_6$=−7.0 ms, and $Y_7$=−2.5 ms. The pre-ACR unit 162 applies the calculated differences to Equation (4) to calculate fixed errors. The fixed errors are calculated as $X_1$=4.5 ms, $X_2$=6.5 ms, and $X_3$=2.0 ms.

After fixed errors are calculated, pre-ACR terminates, and the image forming apparatus 100 enters a print standby state. Thereafter, when a print command is received, printing is performed, and simultaneously main-ACR is performed. If the image forming controller 161 transfers main-test patterns $MP_1$ of a first color to non-image areas of the intermediate transfer body 140, the first sensing units 151 sense the transferred main-test patterns $MP_1$ of the first color, and measure a time $MT_{11}$ taken for the main-test patterns $MP_1$ to be sensed from when scanning starts.

The measured time $MT_{11}$ may be different from a time $PT_{11}$ measured during pre-ACR due to a change in inner temperature of the image forming apparatus 100, an impact from the outside, or the like. If the measured time $MT_{11}$ is 673.6 ms, a variable error $Z_1$ calculated by the variable error calculator 163*a* is −2 ms resulting from subtracting the time $MT_{11}$ measured during main-ACR from the time $PT_{11}$ measured during pre-ACR.

The correction amount calculator 163*b* adds the variable error $Z_1$ to the fixed errors $X_1$, $X_2$, and $X_3$, respectively, to obtain correction amounts of 2.5 ms, 4.5 ms, and 0.0 ms. Then, the image forming controller 161 delays a scanning time of the second color by 2.5 ms, delays a scanning time of the third color by 4.5 ms, and scans the fourth color without any delay.

The main-ACR unit 163 may perform main-ACR whenever printing is performed, and since a scanning time of each color is corrected in real time, color misregistration may be prevented in advance.

A control method of an image forming apparatus, according to embodiment, will be described.

Figure 11:
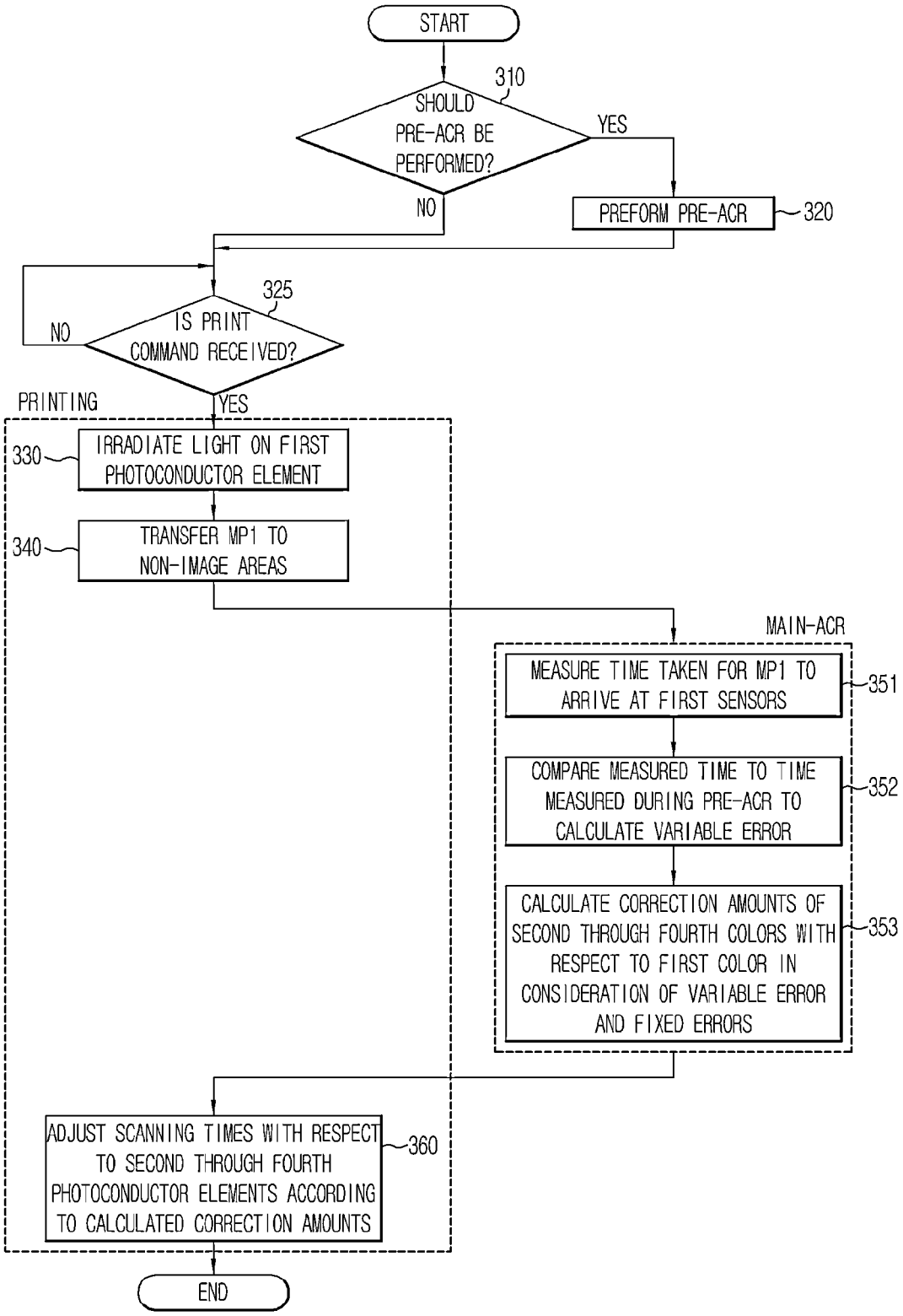
FIG. 11 is a flowchart of a control method of an image forming apparatus, according to an exemplary embodiment.

FIG. 11 is a flowchart of a control method of an image forming apparatus, according to an exemplary embodiment. In this exemplary embodiment, the image forming apparatus includes first sensing units arranged between first and second photoconductor elements and second sensing units arranged after the fourth photoconductor element.

Referring to FIG. 11, it is determined whether pre-ACR should be performed (310). It can be determined that pre-ACR should be performed when it is expected that there will be a change in installation position of elements installed in the image forming apparatus, for example, after the image forming apparatus is manufactured, after an element (for example, a photoconductor element, a developing unit, or a light scanning unit) of the image forming apparatus is replaced with a new one, or when an impact from the outside is applied to the image forming apparatus.

If it is determined in step 310 that pre-ACR should be performed, pre-ACR is performed to calculate fixed errors (320). Pre-ACR have been described in detail above.

Thereafter, it is determined whether a print command is received (325). When a print command is received, printing starts, and simultaneously main-ACR is performed. That is, light scanning onto the first photoconductor element starts (330), and main-test patterns $MP_1$ of a first color are transferred to non-image areas of an intermediate transfer body (340). The non-image areas may be areas between paper sheets that are successively delivered, or areas out of the width of paper.

First sensing units sense the main test patterns $MP_1$ of the first color, and measure a time $MT_{11}$ taken for the main test patterns MP1 to be sensed from when scanning starts (351).

Then, the first sensing units compare the time $MT_{11}$ to a time $PT_{11}$ measured during pre-ACR to calculate a variable error (352). More specifically, a difference between a time $PT_{11}$ taken for pre-test patterns $PP_1$ of the first color to be sensed from when scanning starts and a time $MT_{11}$ taken for the main-test patterns $MP_1$ of the first color to be sensed from when scanning starts is calculated as the variable error $Z_1$.

Then, correction amounts of second, third, and fourth colors are calculated in consideration of the variable error $Z_1$ and fixed errors $X_1$, $X_2$, and $X_3$ (353). More specifically, the fixed error $X_1$ of the second color calculated during pre-ACR is added to the variable error $Z_1$ to calculate a correction amount of the second color, the second error $X_2$ of the third color calculated during pre-ACR is added to the variable error $Z_1$ to calculate a correction amount of the third color, and the fixed error $X_3$ of the fourth color calculated during pre-ACR is added to the variable error $Z_1$ to calculate a correction amount for the fourth color.

Then, scanning times of the second, third, and fourth photoconductor elements are adjusted according to the calculated correction amounts of the second, third, and third colors (360). If the sign of a correction amount is positive (+), scanning may be delayed, and if the sign of a correction amount is negative (−), scanning may be performed earlier.

Figure 12:
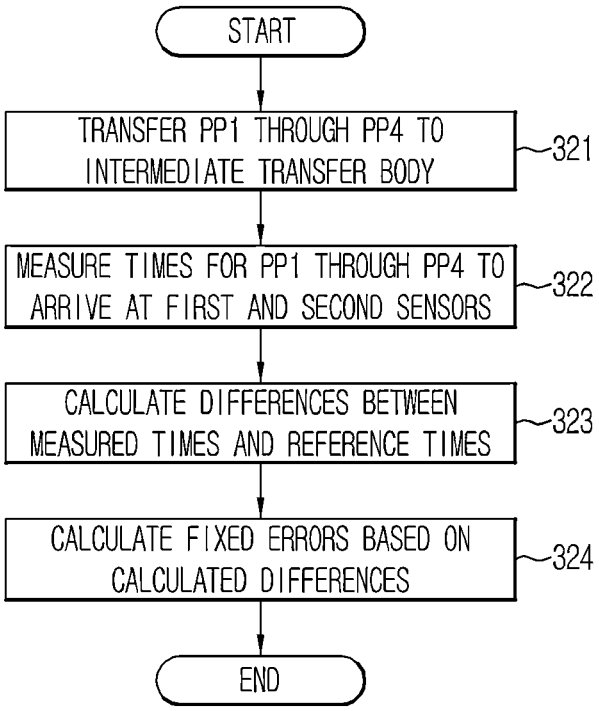
FIG. 12 is a flowchart of a pre-ACR operation in the control method illustrated in FIG. 11.

FIG. 12 is a flowchart of a pre-ACR operation in the control method illustrated in FIG. 11.

Referring to FIG. 12, pre-test patterns $PP_1$ of a first color through pre-test patterns $PP_4$ of a fourth color are transferred to an intermediate transfer body (321). The pre-test patterns may be any patterns capable of being recognized by sensing units.

Then, times taken for the pre-test patterns $PP_1$ of the first color through pre-test patterns $PP_4$ of the fourth color to arrive at first sensing units and second sensing units are measured (322). More specifically, a time $PT_{11}$ taken for the pre-test patterns $PP_1$ of the first color to arrive at the first sensing units 131 from when scanning starts, a time $PT_{14}$ taken for the pre-test patterns $PP_1$ of the first color to arrive at the fourth sensing units 134, a time $PT_{24}$ taken for the pre-test patterns $PP_2$ of the second color to arrive at the fourth sensing units 134 from when scanning starts, and a time $PT_{34}$ taken for the pre-test patterns $PP_3$ of the third color to arrive at the fourth sensing units 134 from when scanning starts, and a time $PT_{44}$ taken for the pre-test patterns $PP_4$ of the fourth color to arrive at the fourth sensing units 134 from when scanning starts are measured. The measured times are used to calculate the variable error in step 352 of FIG. 11 as described above.

Then, differences between the measured times and the corresponding reference times are calculated (323). The reference times are values $T_{ij}$ calculated by Equation (1) by applying design values of individual elements.

Successively, fixed errors are calculated from the differences between the measured times and the reference times (324). The fixed errors are values obtained by expressing a position error $X_1$ of the second color, a position error $X_2$ of the third color, and a position error $X_3$ of the fourth color with respect to the first color, as times. The fixed errors may be calculated by Equation (4).

Then, pre-ACR terminates, and the corresponding image forming apparatus enters a print standby state. Thereafter, when a print command is received, main-ACR is performed using times $PT_{11}$, $PT_{14}$, $PT_{34}$, and $PT_{44}$ taken for pre-test patterns of individual colors to be sensed by the first and second sensing units and the fixed errors $X_1$, $X_2$, and $X_3$.

In the case in which misregistrations of individual colors are continuously generated, only two sensing units can be used like the exemplary embodiments of FIGS. 11 and 12. Otherwise, one or more sensing units may be arranged every photoconductor element so that real-time correction can be performed in a unit of a color.

Figure 13:
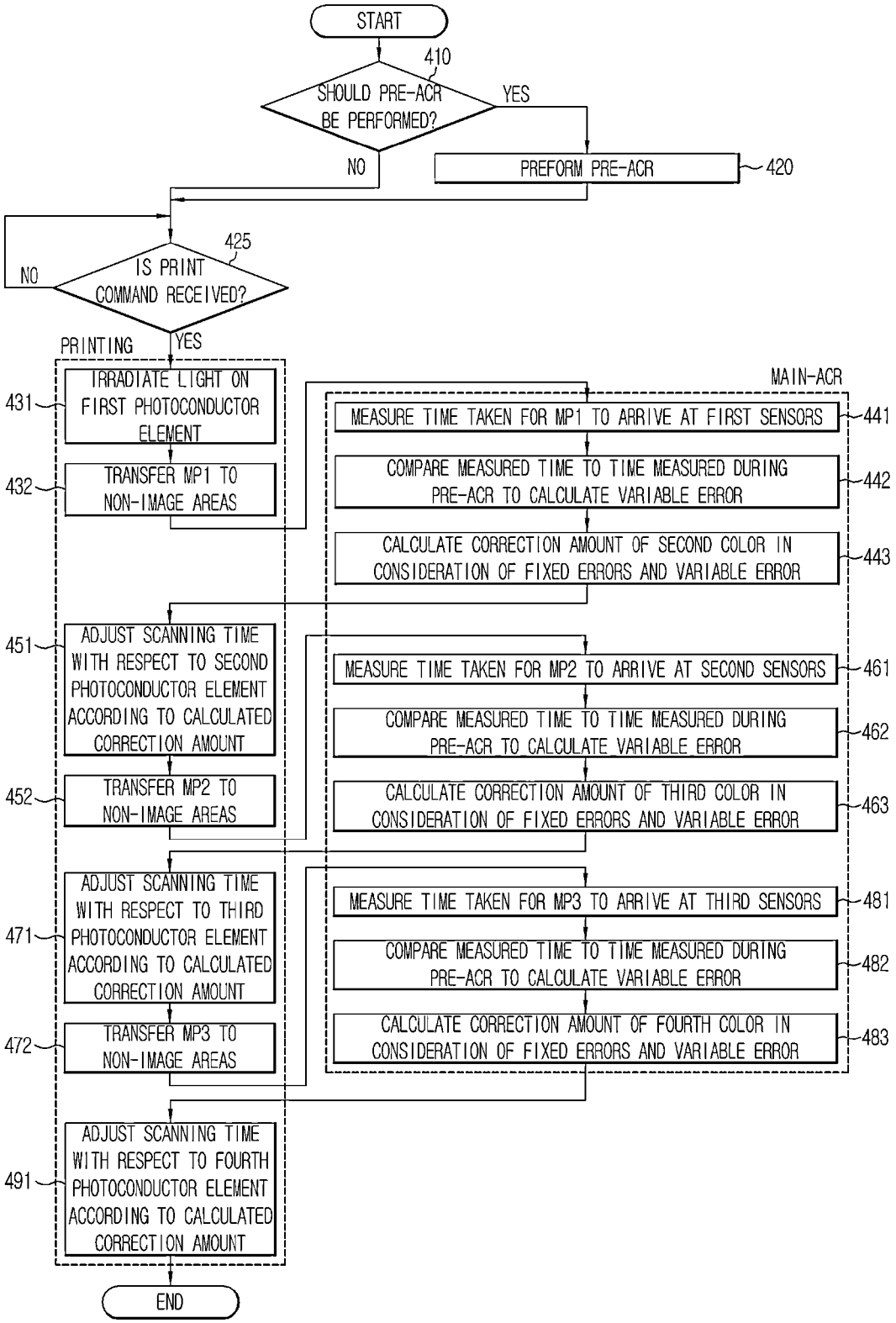
FIG. 13 is a flowchart of a control method of an image forming apparatus having four sensing units, according to an exemplary embodiment.

FIG. 13 is a flowchart of a control method of an image forming apparatus having four sensing units, according to an exemplary embodiment. The four sensing units are one or more first sensing units arranged between first and second photoconductor elements, one or more second sensing units arranged between the second and third photoconductor elements, one or more third sensing units arranged between the third and fourth photoconductor elements, and one or more fourth sensing units arranged after the fourth photoconductor element.

Referring to FIG. 13, it is determined whether pre-ACR should be performed (410). It can be determined that pre-ACR should be performed when it is expected that there will be a change in installation position of elements installed in an image forming apparatus, for example, after the image forming apparatus is manufactured, after an element (for example, a photoconductor element, a developing unit, or a light scanning unit) of the image forming apparatus is replaced with a new one, or when an impact from the outside is applied to the image forming apparatus.

If it is determined in step 410 that pre-ACR should be performed, pre-ACR is performed to calculate fixed errors (420). The pre-ACR has been described in detail above.

Thereafter, when a print command is received (425), printing is performed, and simultaneously main-ACR is performed. Then, light scanning onto the first photoconductor element starts (431), and main test patterns $MP_1$ of a first color are transferred to non-image areas of an intermediate transfer body (432). The non-image areas may be areas between paper sheets that are successively delivered, or areas out of the width of paper.

The first sensing units sense the main test patterns $MP_1$ of the first color, and measure a time $MT_{11}$ taken for the main test patterns $MP_1$ of the first color to be sensed from when scanning starts (441).

Then, the time $MT_{11}$ is compared to a time $PT_{11}$ measured during pre-ACR to calculate a variable error $Z_1$ (442). More specifically, a difference between a time $PT_{11}$ taken for pre-test patterns $PP_1$ of the first color to be sensed by the first sensing units from when scanning starts and a time $MT_{11}$ taken for main test patterns $MP_1$ of the first color to be sensed by the first sensing units from when scanning starts is calculated as the variable error $Z_1$.

Then, a correction amount of a second color is calculated from the variable error $Z_1$ and the fixed error $X_1$ of the second color (443). More specifically, the fixed error $X_1$ of the second color calculated during pre-ACR may be added to the variable error $Z_1$, and the resultant value $X_1+Z_1$ may be calculated as a correction amount of the second color.

Then, a scanning time with respect to the second photoconductor element is adjusted according to the correction amount of the second color (451). When the sign of a correction amount is positive (+), scanning may be delayed, and when the sign of a correction amount is negative (−), scanning may be performed earlier. Then, main-test patterns $MP_2$ of the second color are transferred to the non-image areas (452).

Then, the second sensing units sense the main test patterns $MP_2$ of the second color, and measures a time $MT_{22}$ taken for the main test patterns $MP_2$ of the second color to be sensed from when scanning starts (461).

Successively, the time $MT_{22}$ is compared to a time $PT_{22}$ measured during pre-ACR to calculate a variable error $Z_2$ (462). More specifically, a difference between a time $PT_{22}$ taken for pre-test patterns $PP_2$ of the second color to be sensed by the second sensing units from when scanning starts and a time $MT_{22}$ taken for main test patterns $MP_2$ of the second color to be sensed by the second sensing units from when scanning starts is calculated as the variable error $Z_2$.

Then, a correction amount for a third color is calculated from the variable error $Z_2$ and the fixed error $X_3$ of the third color (463). More specifically, the fixed error $X_1$ of the third color calculated during pre-ACR may be added to the variable error $Z_2$, and the resultant value $X_2+Z_2$ may be calculated as a correction amount of the third color.

Then, a scanning time with respect to the third photoconductor element is adjusted according to the correction amount of the third color (471). When the sign of a correction amount is positive (+), scanning may be delayed, and when the sign of a correction amount is negative (−), scanning may be performed earlier. Then, main-test patterns $MP_3$ of the third color are transferred to the non-image areas (472).

Then, the third sensing units sense the main test patterns $MP_3$ of the third color, and measures a time $MT_{33}$ taken for the main test patterns $MP_{33}$ of the third color to be sensed from when scanning starts (481).

Then, the time $MT_{33}$ is compared to a time $PT_{33}$ measured during pre-ACR to calculate a variable error $Z_3$ (482). More specifically, a difference between a time $PT_{33}$ taken for pre-test patterns $PP_3$ of the third color to be sensed by the third sensing units from when scanning starts and a time $MT_{33}$ taken for main test patterns $MP_3$ of the third color to be sensed by the third sensing units from when scanning starts is calculated as the variable error $Z_3$.

Then, a correction amount of a fourth color is calculated from the variable error $Z_3$ and the fixed error $X_3$ of the fourth color (483). More specifically, the fixed error $X_3$ of the fourth color calculated during pre-ACR may be added to the variable error $Z_3$, and the resultant value $X_3+Z_3$ may be calculated as a correction amount of the fourth color.

Then, a scanning time with respect to the fourth is adjusted according to the correction amount of the fourth color (491). When the sign of a correction amount is positive (+), scanning may be delayed, and when the sign of a correction amount is negative (−), scanning may be performed earlier.

Figure 14:
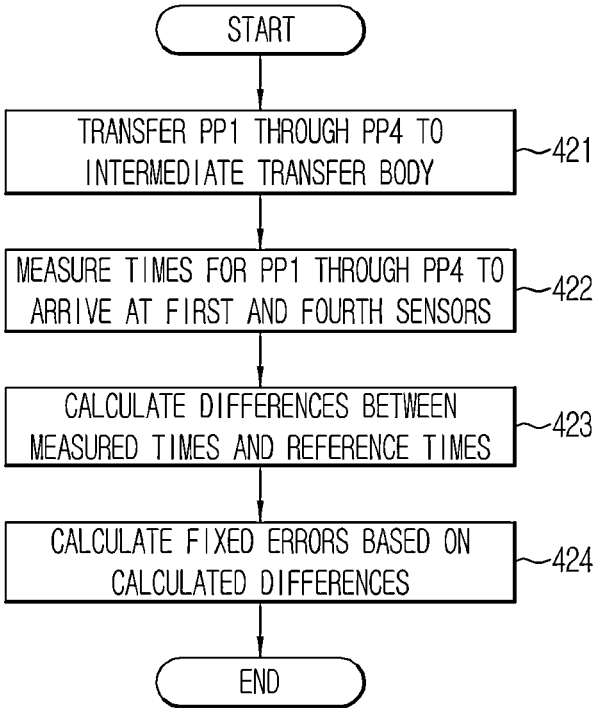
FIG. 14 is a flowchart of a pre-ACR operation in the control method illustrated in FIG. 13.

FIG. 14 is a flowchart of a pre-ACR operation in the control method illustrated in FIG. 13.

Referring to FIG. 14, pre-test patterns $PP_1$ of a first color through pre-test patterns $PP_4$ of a fourth color are transferred to an intermediate transfer body (421). The pre-test patterns may be any patterns capable of being recognized by sensing units.

Then, times taken for the pre-test patterns $PP_1$ of the first color through pre-test patterns $PP_4$ of the fourth color to arrive at first sensing units through fourth sensing units are measured (422). More specifically, a time $PT_{11}$ taken for the pre-test patterns $PP_1$ of the first color to arrive at the first sensing units from when scanning starts, a time $PT_{14}$ taken for the pre-test patterns $PP_1$ of the first color to arrive at the fourth sensing units, a time $PT_{22}$ taken for the pre-test patterns $PP_2$ of the second color to arrive at the second sensing units from when scanning starts, a time $PT_{24}$ taken for the pre-test patterns $PP_2$ of the second color to arrive at the fourth sensing units, a time $PT_{33}$ taken for the pre-test patterns $PP_3$ of the third color to arrive at the third sensing units from when scanning starts, a time $PT_{34}$ taken for the pre-test patterns $PP_3$ of the third color to arrive at the fourth sensing units, and a time $PT_{44}$ taken for the pre-test patterns $PP_4$ of the fourth color to arrive at the fourth sensing units are measured. The times $PT_{11}$, $PT_{22}$, $PT_{33}$, and $PT_{44}$ among the measured times are used to calculate a variable error in the exemplary embodiment of FIG. 14 as described above.

Then, differences between the measured times and the corresponding reference times are calculated (423). The reference times are values $T_{ij}$ calculated by Equation (1) by applying design values of individual elements.

Then, fixed errors are calculated from the differences (424). The fixed errors are values obtained by expressing a position error $X_1$ of the second color, a position error $X_2$ of the third color, and a position error $X_3$ of the fourth color with respect to the first color, as times. The fixed errors may be calculated by Equation (4).

Then, pre-ACR terminates, and the corresponding image forming apparatus enters a print standby state. Thereafter, when a print command is received, main-ACR is performed using times $PT_{11}$, $PT_{14}$, $PT_{24}$, $PT_{34}$, and $PT_{44}$ taken for pre-test patterns of individual colors to be sensed by the first through fourth sensing units and the fixed errors $X_1$, $X_2$, and $X_3$. Main-ACR may be performed whenever printing is performed, so that color registration can be performed in real time.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a plurality of photoconductor elements arranged in a movement direction of an intermediate transfer body, and corresponding to a plurality of colors, the plurality of colors including a first color and remaining colors;

a light scanner which irradiates light onto the plurality of photoconductor elements to form electrostatic latent images;

a developer which supplies toner to the plurality of photoconductor elements to form toner images on the plurality of photoconductor elements;

the intermediate transfer body to which the toner images formed on the plurality of photoconductor elements are transferred;

a first sensor, which is arranged between a first photoconductor element and a second photoconductor element among the plurality of photoconductor elements, and which senses the toner images transferred to the intermediate transfer body;

a final sensor, which is arranged after a final photoconductor element among the plurality of photoconductor elements, and which senses the toner images transferred to the intermediate transfer body; and a controller which calculates fixed errors of the remaining colors, with respect to the first color corresponding to the first photoconductor element, based on output values of the final sensor before printing, which calculates a variable error based on an output value of the first sensor during printing, and which adjusts a scanning time of at least one color of the remaining colors in real time in consideration of the fixed errors and the variable error.

2. The image forming apparatus according to claim 1, wherein the controller comprises image forming controller which controls the light scanner such that a plurality of pre-test patterns are transferred from the plurality of photoconductor elements to the intermediate transfer body before printing, and controls the light scanner such that a main-test pattern is transferred from the first photoconductor element to an non-image area of the intermediate transfer body during printing.

3. The image forming apparatus according to claim 2, wherein the controller further comprises a pre-Auto Color Registration (pre-ACR) unit which calculates the fixed errors based on output values of the final sensor that has sensed the pre-test patterns.

4. The image forming apparatus according to claim 3, wherein the controller further comprises a main-ACR unit calculating the variable error based on an output value of the first sensor that has sensed the main test pattern, and calculating scanning time correction amounts for the remaining colors, based on the variable error and the fixed errors.

5. The image forming apparatus according to claim 4, wherein each of the first sensor and the final sensor comprises an optical sensor and a counter.

6. The image forming apparatus according to claim 5, wherein the plurality of photoconductor elements comprise the first photoconductor element corresponding to the first color, the second photoconductor element corresponding to a second color, a third photoconductor element corresponding to a third color, and a fourth photoconductor element corresponding to a fourth color, the final photoconductor element is the fourth photoconductor element, and the final sensor is a fourth sensor.

7. The image forming apparatus according to claim 6, wherein the first sensor measures a time taken for a pre-test pattern of the first color to be sensed from when scanning onto the first photoconductor element starts.

8. The image forming apparatus according to claim 6, wherein the pre-ACR unit calculates a fixed error of the second color with respect to the first color, a fixed error of the third color with respect to the first color, and a fixed error of the fourth color with respect to the first color, based on the times measured by the fourth sensor.

9. The image forming apparatus according to claim 8, wherein the first sensor measures a time taken for a main-test pattern of the first color to be sensed from when scanning onto the first photoconductor element starts.

10. The image forming apparatus according to claim 9, wherein the main ACR unit compares a time taken for the pre-test pattern of the first color to be sensed from when scanning onto the first photoconductor element starts, to a time taken for the main-test pattern of the first color to be sensed from when scanning onto the first photoconductor element starts, thereby calculating a variable error.

11. The image forming apparatus according to claim 10, wherein the main ACR unit adds a fixed error of the second color with respect to the first color to the variable error to calculate a scanning time correction amount of the second color, adds a fixed error of the third color with respect to the first color to the variable error to calculate a scanning time correction amount of the third color, and adds a fixed error of the fourth color with respect to the first color to the variable error to calculate a scan time correction amount of the fourth color.

12. The image forming apparatus according to claim 11, wherein the controller adjusts scanning times of the first through fourth colors according to the scanning time correction amounts of the first through fourth colors.

13. The image forming apparatus according to claim 7, wherein the fourth sensor measures a time taken for the pre-test pattern of the first color to be sensed from when scanning onto the first photoconductor element starts, a time taken for a pre-test pattern of the second color to be sensed from when scanning onto the second photoconductor element starts, a time taken for a pre-test pattern of the third color to be sensed from when scanning onto the third photoconductor element starts, and a time taken for a pre-test pattern of the fourth color to be sensed from when scanning onto the fourth photoconductor element starts.

14. The image forming apparatus according to claim 13, further comprising a second sensor arranged between the second photoconductor element and the third photoconductor element, and a third sensor arranged between the third photoconductor element and the fourth photoconductor element.

15. The image forming apparatus according to claim 14, wherein the second sensor measures a time taken for the pre-test pattern of the second color to be sensed from when scanning onto the second photoconductor element starts, and the third sensor measures a time taken for the pre-test pattern of the third color to be sensed from when scanning onto the third photoconductor element starts.

16. The image forming apparatus according to claim 15, wherein the pre-ACR unit calculates a fixed error of the second color with respect to the first color, a fixed error of the third color with respect to the first color, and a fixed error of the fourth color with respect to the first color, based on the times measured by the fourth sensor.

17. The image forming apparatus according to claim 16, wherein the first sensor measures a time taken for a main-test pattern of the first color to be sensed from when scanning onto the first photoconductor element starts.

18. The image forming apparatus according to claim 17, wherein the main ACR unit compares the time taken for the pre-test pattern of the first color to be sensed from when scanning onto the first photoconductor element starts, to the time taken for the main-test pattern of the first color to be sensed from when scanning onto the first photoconductor element starts, thereby calculating a first variable error.

19. The image forming apparatus according to claim 18, wherein the main ACR unit adds a fixed error of the second color with respect to the first color to the first variable error, to calculate a scanning time correction amount of the second color.

20. The image forming apparatus according to claim 19, wherein the controller controls the light scanner according to the scanning time correction amount of the second color so that the main-test pattern of the second color is transferred from the second photoconductor element to a non-image area of the intermediate transfer body.

21. The image forming apparatus according to claim 20, wherein the second sensor measures a time taken for the main-test pattern of the second color to be sensed from when scanning onto the second photoconductor element starts.

22. The image forming apparatus according to claim 21, wherein the main ACR unit compares the time taken for the pre-test pattern of the second color to be sensed from when scanning onto the second photoconductor element starts, to the time taken for the main-test pattern of the second color to be sensed from when scanning onto the second photoconductor element starts, thereby calculating a second variable error.

23. The image forming apparatus according to claim 22, wherein the main ACR unit adds a fixed error of the third color with respect to the first color to the second variable error, to calculate a scanning time correction amount of the third color.

24. The image forming apparatus according to claim 23, wherein the controller controls the light scanner according to the scanning time correction amount of the third color so that the main-test pattern of the third color is transferred from the third photoconductor element to the non-image area of the intermediate transfer body.

25. The image forming apparatus according to claim 24, wherein the third sensor measures a time taken for a main-test pattern of the third color to be sensed from when scanning onto the third photoconductor element starts.

26. The image forming apparatus according to claim 25, wherein the main ACR unit compares the time taken for the pre-test pattern of the third color to be sensed from when scanning onto the third photoconductor element starts, to the time taken for the main-test pattern of the third color to be sensed from when scanning onto the third photoconductor element starts, thereby calculating a third variable error.

27. The image forming apparatus according to claim 26, wherein the main ACR unit adds a fixed error of the fourth color with respect to the first color to the third variable error, to calculate a scanning time correction amount of the fourth color.

28. A control method of an image forming apparatus, the image forming apparatus including a plurality of photoconductor elements corresponding to a plurality of colors, a first sensor arranged between a first photoconductor element and a second photoconductor element arranged in a movement direction of an intermediate transfer body, and a final sensor arranged after a final photoconductor element, the control method comprising:

if it is determined that pre-Auto Color Registration (pre-ACR) is needed, transferring a plurality of pre-test patterns of the plurality of colors to the intermediate transfer body before printing, the plurality of colors including a first color and remaining colors;

sensing the pre-test patterns of the plurality of colors through the final sensor;

calculating fixed errors of the remaining colors, with respect to the first color, based on output values of the final sensor;

if a print command is received, transferring a main-test pattern of the first color to a non-image area of the intermediate transfer body during printing;

sensing a main-test pattern of the first color through the first sensor;

calculating a variable error based on an output value of the first sensor; and calculating a scanning time correction amount of at least one color of the remaining colors in consideration of the variable error and the fixed errors.

29. The control method according to claim 28, wherein the calculating of the fixed errors of the remaining colors comprises calculating differences between output values of the final sensor and reference values according to design values of the image forming apparatus.

30. The control method according to claim 29, further comprising sensing the pre-test pattern of the first color through the first sensor, wherein the calculating of the variable error comprises calculating a difference between an output value of the first sensor that has sensed the pre-test pattern of the first color and an output value of the first sensor that has sensed the main-test pattern of the first color.

31. The control method according to claim 30, wherein the calculating of the scanning time correction amount of the at least one color of the remaining colors comprises adding the variable error to the respective fixed errors of the remaining colors to calculate scanning time correction amounts of the remaining colors.

32. The control method according to claim 29, wherein the plurality of photoconductor elements comprise the first photoconductor element corresponding to the first color, the second photoconductor element corresponding to a second color, a third photoconductor element corresponding to a third color, and a fourth photoconductor element corresponding to a fourth color, the final photoconductor element is the fourth photoconductor element, the final sensor is a fourth sensor, and the image forming apparatus further comprises a second sensor arranged between the second photoconductor element and the third photoconductor element, and a third sensor arranged between the third photoconductor element and the fourth photoconductor element.

33. The control method according to claim 32, further comprising:

sensing a pre-test pattern of the first color through the first sensor;

sensing a pre-test pattern of the second color through the second sensor; and sensing a pre-test pattern of the third color through the third sensor.

34. The control method according to claim 33, wherein the calculating of the variable error comprises comparing an output value of the first sensor that has sensed the pre-test pattern of the first color, to an output value of the first sensor that has sensed the main-test pattern of the first color, thereby calculating a first variable error.

35. The control method according to claim 34, wherein the calculating of the scanning time correction amount of the at least one color of the remaining colors comprises adding a fixed error of the second color with respect to the first color to the first variable error, to calculate a scanning time correction amount of the second color.

36. The control method according to claim 35, further comprising:

transferring a main-test pattern of the second color to a non-image area of the intermediate transfer body in consideration of a scanning time correction amount of the second color, during printing;

sensing a main-test pattern of the second color through the second sensor; and calculating a second variable error based on an output value of the second sensor.

37. The control method according to claim 36, wherein the calculating of the second variable error comprises calculating a difference between an output value of the second sensor that has sensed the pre-test pattern of the second color and an output value of the second sensor that has sensed the main-test pattern of the second color.

38. The control method according to claim 37, further comprising calculating a scanning time correction amount of the third color by adding a fixed error of the third color with respect to the first color to the second variable error.

39. The control method according to claim 38, further comprising:

transferring a main-test pattern of the third color to the non-image area of the intermediate transfer body in consideration of a scanning time correction amount of the third color, during printing;

sensing a main-test pattern of the third color through the third sensor; and calculating a third variable error based on an output value of the third sensor.

40. The control method according to claim 39, wherein the calculating of the third variable error comprises calculating a difference between an output value of the third sensor that has sensed the pre-test pattern of the third color and an output value of the third sensor that has sensed the main-test pattern of the third color.

41. The control method according to claim 40, further comprising adjusting a scanning time of the fourth color in consideration of the fixed error of the fourth color with respect to the first color and the third variable error.

* * * * *